US008101845B2

(12) United States Patent
Kobayashi

(10) Patent No.: US 8,101,845 B2
(45) Date of Patent: Jan. 24, 2012

(54) INFORMATION PROCESSING APPARATUS, METHOD, AND PROGRAM

(75) Inventor: Yoshiyuki Kobayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 604 days.

(21) Appl. No.: 11/813,411

(22) PCT Filed: Nov. 8, 2006

(86) PCT No.: PCT/JP2006/322273

§ 371 (c)(1),
(2), (4) Date: Jul. 5, 2007

(87) PCT Pub. No.: WO2007/055238

PCT Pub. Date: May 18, 2007

(65) Prior Publication Data

US 2009/0287323 A1 Nov. 19, 2009

(30) Foreign Application Priority Data

Nov. 8, 2005 (JP) ..... 2005-323153
Oct. 12, 2006 (JP) ..... 2006-278351

(51) Int. Cl.
*G10H 1/18* (2006.01)

(52) U.S. Cl. ..... 84/616; 84/609; 84/615; 84/649; 84/653; 84/654

(58) Field of Classification Search ..... None
See application file for complete search history.

(56) References Cited

U.S. PATENT DOCUMENTS 5,698,807 A * 12/1997 Massie et al. ..... 84/661
5,986,199 A * 11/1999 Peevers ..... 84/603
6,787,689 B1 * 9/2004 Chen ..... 84/600
6,951,977 B1 10/2005 Streitenberger et al.
7,026,536 B2 * 4/2006 Lu et al. ..... 84/612
7,035,742 B2 4/2006 Klefenz et al.
7,132,595 B2 * 11/2006 Lu et al. ..... 84/612

(Continued)

FOREIGN PATENT DOCUMENTS

JP 2004-233965 8/2004

(Continued)

OTHER PUBLICATIONS

M. Goto, "Can Computer Clap in Rithmn to Music?", Bit, vol. 28, No. 3, 1996, p. 4-11.

(Continued)

*Primary Examiner* — Marlo Fletcher
(74) *Attorney, Agent, or Firm* — Finnegan, Henderson, Farabow, Garrett & Dunner, L.L.P.

(57) ABSTRACT

The present invention relates to an information processing apparatus, method, and program that are capable of analysing a waveform of a tune involving a modulation with a reduced operation amount. A beat feature extraction section 41 extracts a feature related to a beat from sections of a waveform of a tune involving a modulation, each of the sections corresponding to each beat. A beat feature removal section 42 removes a phase component from a frequency component of each feature extracted. An autocorrelation map generation section 43 generates, based on the features whose phase components have been removed, autocorrelation information representing correlation between one section and another section. This enables the waveform of the tune involving a modulation to be analyzed with a reduced operation amount. The present invention is applicable to an information processing apparatus.

11 Claims, 40 Drawing Sheets

U.S. PATENT DOCUMENTS

| | | | | |
|---|---|---|---|---|
| 7,183,479 | B2 * | 2/2007 | Lu et al. | 84/612 |
| 2004/0068401 | A1 | 4/2004 | Herre et al. | |
| 2004/0094019 | A1 | 5/2004 | Herre et al. | |
| 2004/0255758 | A1 | 12/2004 | Klefenz et al. | |
| 2005/0211072 | A1 * | 9/2005 | Lu et al. | 84/612 |
| 2005/0211077 | A1 | 9/2005 | Kobayashi | |
| 2005/0217463 | A1 | 10/2005 | Kobayashi | |
| 2005/0241465 | A1 | 11/2005 | Goto | |
| 2006/0048634 | A1 * | 3/2006 | Lu et al. | 84/612 |
| 2006/0064299 | A1 | 3/2006 | Uhle et al. | |
| 2006/0075884 | A1 | 4/2006 | Streitenberger et al. | |
| 2007/0022867 | A1 * | 2/2007 | Yamashita | 84/612 |
| 2008/0078280 | A1 * | 4/2008 | Okazaki et al. | 84/604 |
| 2009/0056526 | A1 * | 3/2009 | Yamashita et al. | 84/611 |

FOREIGN PATENT DOCUMENTS

| | | |
|---|---|---|
| JP | 2005-274708 | 10/2005 |
| JP | 2005-275068 | 10/2005 |
| WO | WO 2005/122136 | 12/2005 |
| WO | WO 2006/034743 | 4/2006 |

OTHER PUBLICATIONS

M. Goto, "Smart Music KIOSK: Music Listening Station with Chorus-search Function", IPSJ Journal, vol. 44, No. 10, 2003, p. 2737-2747.

H. Fujii, "Melody Analysis for Automatic Musical Arrange—Extraction of Melody Structure—", The 37th National Convention of IPSJ, 5R-5, 1988, p. 1967-1968.

J. Muramatsu, "Extyraction of Features of 'Sabi' from the Score in Japanese Popular Music Songs—in the Case of Tetsuya Komuro—", IPSJ SIG Notes, vol. 2000, No. 49,. 2000-MUS-35-1, 2000 p. 1-6.

S. Gayama, "A Method for Detecting Chord Progressions and Its Application to Searching Similar Types of Music", Pioneer R&D, vol. 14, No. 2, 2004, p. 1-7.

S. Gayama, "A Method for Detecting Highlights of Music by Chord Progressions and Its Application to Embedded Systems,", Pioneer R&D, vol. 15, No. 1, Feb. 2005, p. 49-54.

M. Goto, "A Real-time Music Scene Description System: System Overview and Extension of F0 Estimation Method", IPSJ SIG Notes, vol. 2000, No. 94, 2000-MUS-372, 2000, p. 9-16.

* cited by examiner

INFORMATION PROCESSING APPARATUS, METHOD, AND PROGRAM

TECHNICAL FIELD

The present invention relates to an information processing apparatus, method, and program and, in particular, to an information processing apparatus, method, and program for analyzing a waveform of a tune involving a modulation.

BACKGROUND ART

Various methods have already been proposed for analyzing a structure of a tune. Specifically, by analyzing a waveform of a tune as illustrated in the upper part of FIG. 1, it is found that the tune has a structure as illustrated in the lower part of FIG. 1. That is, assuming that time progresses from the left of the figure to the right, the tune starts with "Introduction" and the subsequent parts thereof are composed of, in order, "Chorus", "Interlude", "Verse A", "Verse B", "Chorus", "Chorus", "Interlude", and so on. Then, based on the result of such analysis, sections corresponding to chouruses are identified in the tune, for example.

Hereinafter, a part of a tune that is positioned in the middle of the time and involves a change in motif and which, in particular, is the roost alluring part of the tune will be referred to as a "chorus", In addition, a unit for making a meter will be hereinafter referred to as a "beat". That is, heats can be counted as they each have a constant temporal duration, and positions of the beats in a measure produce variations in accent (i.e., downbeats and upbeats), and different combinations thereof result in different, meters.

There is also a method in which features are extracted from input audio data; the degree of similarity between the features is calculated to list repetitive sections; the listed repetitive sections are integrated; the detection of repetitive sections involving a modulation is performed; the repetitive sections involving a modulation are integrated; and a section that is appropriate as a chourusesection is selected from the integrated repetitive sections (see, for example, Patent Document 1).

Patent Document 1: Japanese Patent Laid-Open No. 2004-233965

DISCLOSURE OF THE INVENTION

Problems to be Solved by the Invention

In the case where a waveform of a tune that involves a modulation is analysed, handling the modulation involves an increased amount of operation, and therefore, unfortunately, a time required for analysing the waveform of the tune increases.

In the method as disclosed in Japanese Patent Laid-open No. 2004-233965, for example, the section that is appropriate as the chourusesection is selected by performing the detection of the repetitive sections involving the modulation. In this method, however, it sometimes takes a long time to select an appropriate chourusesection.

The present invention has been designed in view of the above circumstances, and enables analysis of the waveform of the tune involving the modulation to be achieved with a reduced amount of operation.

Means for Solving the Problems

One aspect of the present invention is an information processing apparatus including: first extraction means for extracting a first feature from first sections of a waveform of a tune involving a modulation, each of the first sections corresponding to each beat, the first feature being related to the beat; removal means for removing a phase component from a frequency component of each first feature extracted; and generation means for, based on the first features whose phase components have been removed, generating autocorrelation information representing correlation between one first section and another first section.

The information processing apparatus may further include: separation means for, based on the autocorrelation information, separating the beats into a plurality of second sections each containing a succession of beats with high correlation; second extraction means for extracting a second feature from each of the second sections obtained by the separation, the second feature representing a musical feature of the tune; and identification means for, based on the second feature, identifying a tune structure component of the tune in the second sections as separated.

The removal means may remove the phase component from the frequency component of each first feature by a discrete Fourier transform.

The identification means may identify, as the tune structure component, a section corresponding to a chorus of the tune.

The first feature may be energy of each tone in a predetermined number of octaves in the first section.

The second feature may be volume, information concerning a sound source, or a gain of a certain frequency band in the second section.

The second feature may foe a length of the second section, the number of times the second section appears, or the number of times the second section is repeated consecutively.

Based on the first features whose phase components have been removed, the generation means may calculate; at intervals of a predetermined number of beats, the correlation with another first section to generate the autocorrelation information.

The removal means may shuffle the first features before removing the phase component from the frequency component of each first feature.

The removal means may shift the energy of each tone before removing the phase component from the frequency component of each first feature.

One aspect of the present invention is an information processing method including: an extraction step of extracting a feature from sections of a waveform of a tune involving a modulation, each of the sections corresponding to each beat, the feature being related to the beat; a removal step of removing a phase component from a frequency component of each feature extracted; and a generation step of, based on the features whose phase components have been removed, generating autocorrelation information representing correlation between one section and another section.

One aspect of the present invention is a program for causing a computer to perform: an extraction step of extracting a feature from sections of a waveform of a tune involving a modulation, each of the sections corresponding to each beat, the feature being related to the beat; a removal step of removing a phase component from a frequency component of each feature extracted; and a generation step of, based on the features whose phase components have been removed, generating autocorrelation information representing correlation between one section and another section.

In one aspect of the present invention, a first feature is extracted from first sections of a waveform of a tune involving a modulation, each of the first sections corresponding to each beat, the first feature being related to the beat; a phase component is removed from a frequency component of each first feature extracted; and based on the first features whose phase components have been removed, autocorrelation information representing correlation between one first, section and another first section is generated.

Effect of the Invention

As described above, according to one aspect of the present invention, the waveform of a tune involving a modulation can be analyzed with a reduced operation amount.

DESCRIPTION OF REFERENCE SYMBOLS

1 personal computer, 11 CPU, 12 ROM, 13 RAM, 16 input section, 17 output section, 16 recording section, 19 communication section, 20 drive, 21 removable medium, 31 tune structure analysis unit, 41 beat feature extraction section, 42 beat feature removal section, 43 autocorrelation map generation section, 44 segmentation section, 45 music feature extraction section, 46 chorus identification section, 101 beat detection unit, 111 attack information extraction section, 112 basic beat period detection section, 113 tempo determination section, 114 tune feature extraction section, 115 tempo correction section, 116 beat feature extraction section, 117 meter determination section, 118 measure top determination section

BEST MODE FOR CARRYING OUT THE INVENTION

Hereinafter, embodiments of the present invention will be described with reference to the accompanying drawings.

Figure 1:
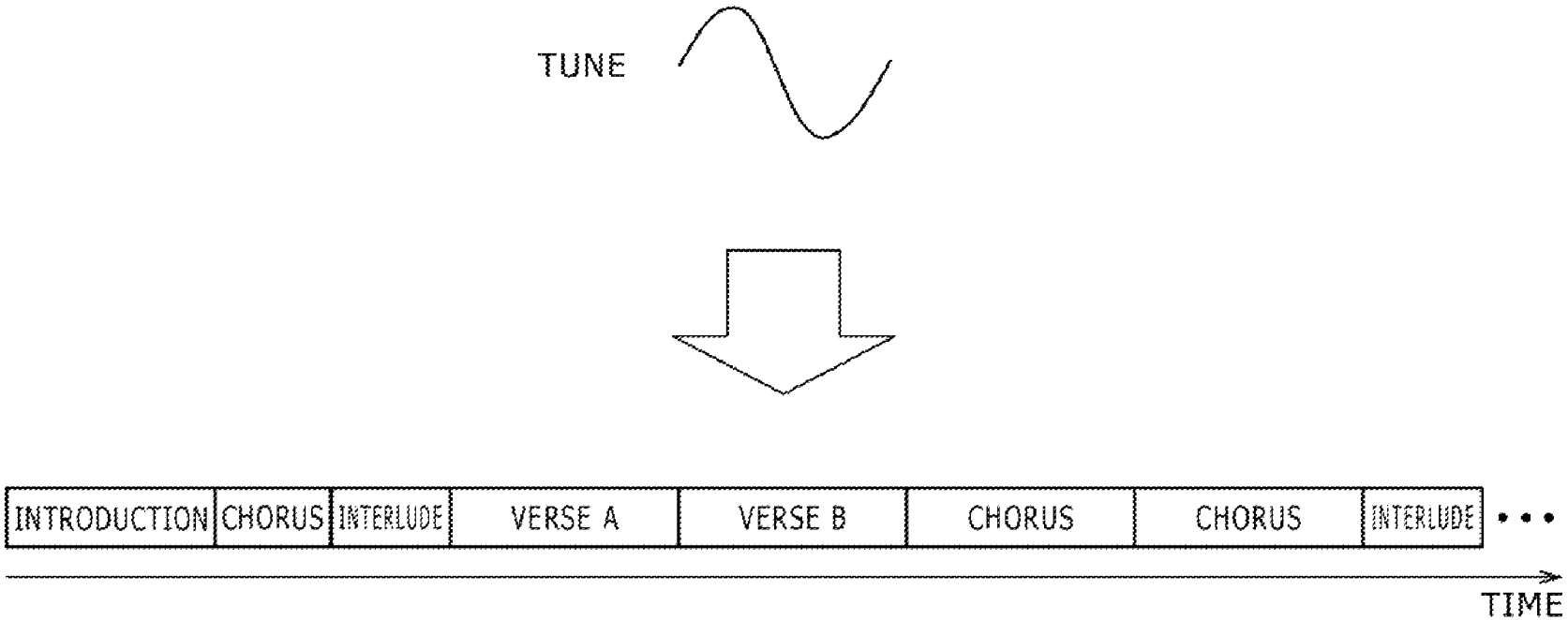
FIG. 1 is a diagram illustrating a related-art method for analyzing a tune structure of a tune.
Figure 2:
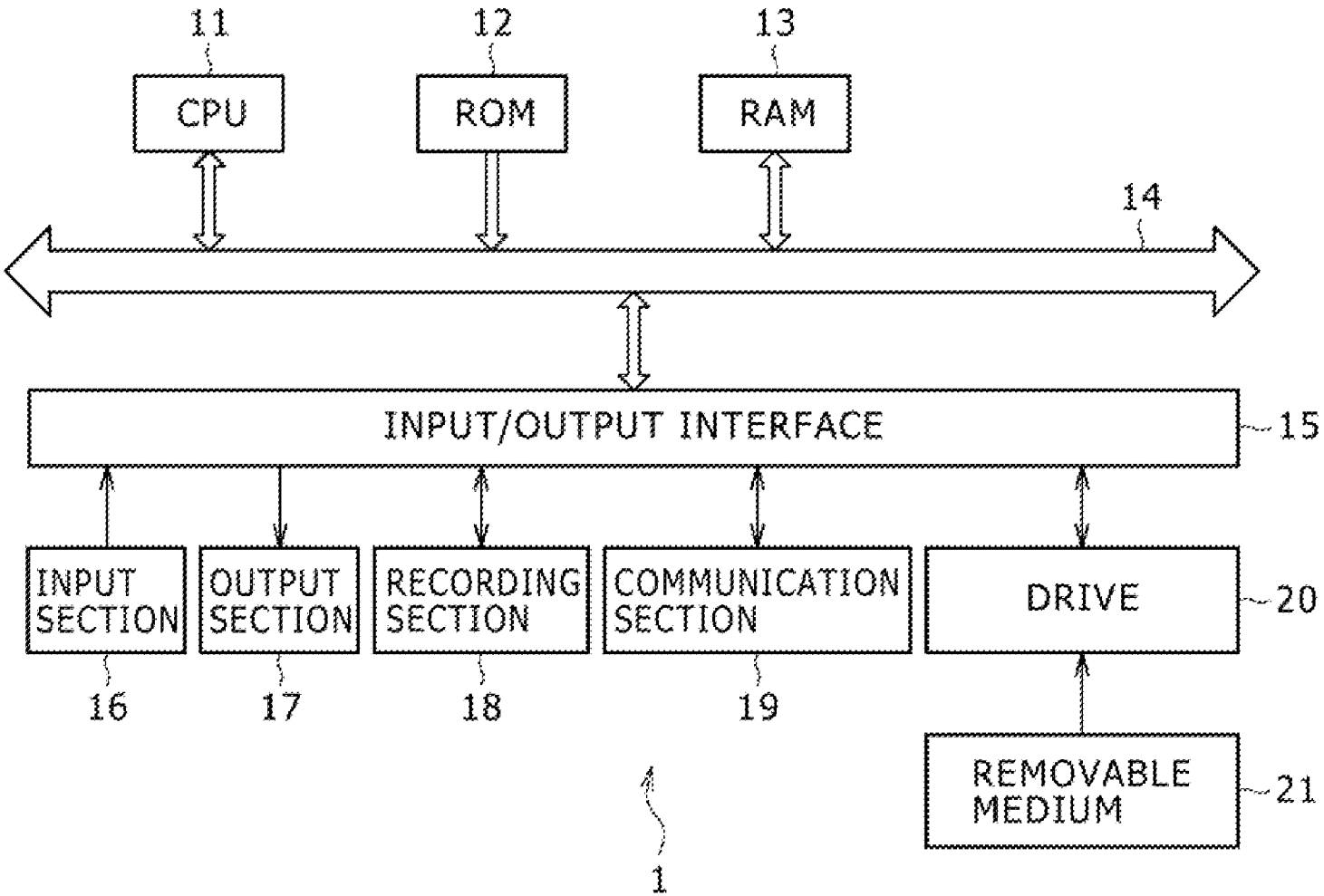
FIG. 2 is a block diagram for explaining an exemplary hardware configuration of a personal computer.

FIG. 2 is a block diagram for explaining an exemplary hardware configuration of a personal computer 1.

The personal computer 1 is a device for performing a predetermined process to record data of a tune and analyze a waveform of the tune that is reproduced from the data of the tune. The personal computer 1 is an example of an information processing apparatus of the present invention.

In the personal computer 1 in the example of FIG. 2, a CPU (Central Processing Unit) 11 executes various processes in accordance with a program stored in a ROM (Read Only Memory) 12 or a program loaded from a recording section 18 to a RAM (Random Access Memory) 13. In the RAM 13, data that is required when the CPU 11 executes the various processes and other data are also stored as appropriate.

The CPU 11, the ROM 12, and the RAM 13 are connected to one another via a bus 14. To the bus 14, an input/output interface 15 is also connected.

To the input/output interface 15 are connected an input section 16 formed by a keyboard, a mouse, etc.; an output section 17 formed by a loudspeaker, a display such as an LCD (Liquid Crystal Display), etc.; the recording section 13 formed by a hard disk, etc.; and a communication section 19 that controls a communication process in relation to another device via a network such as the Internet.

A drive 20 is also connected to the input/output interface 15 as necessary. A removable medium 21, such as a magnetic disk, an optical disk, a magneto-optical disk, or a semiconductor memory, is mounted on the drive 20 as appropriate, and a computer program is read therefrom and installed into the recording section 18 as necessary.

Note that the hardware configuration of the personal computer 1 is not limited to the example of FIG. 2. Any hardware configuration is applicable as long as a functional structure as described below with reference to FIG. 3 is achieved.

Figure 3:
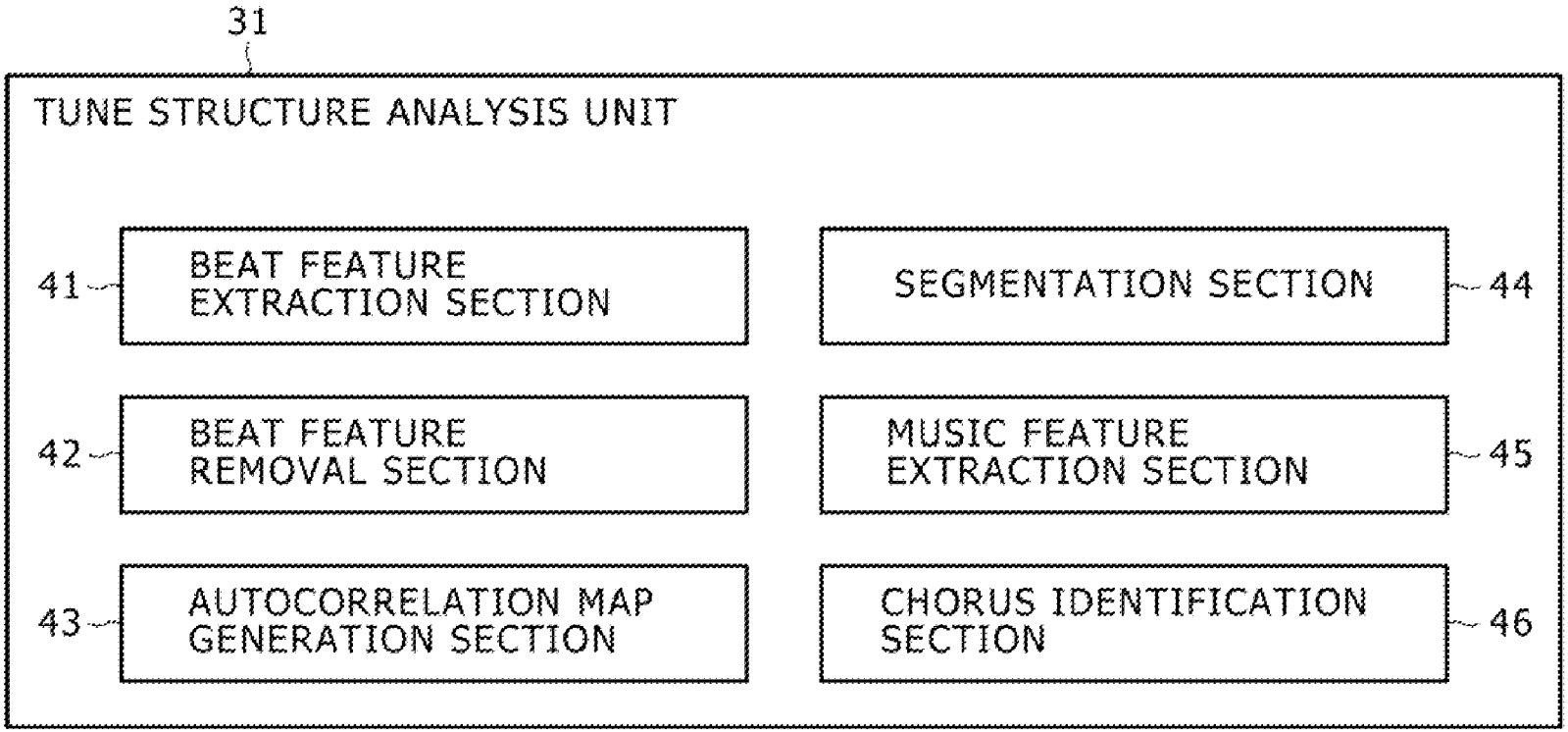
FIG. 3 is a block diagram illustrating an exemplary functional structure of software executed by a CPU of the personal computer.

FIG. 3 is a block diagram illustrating an exemplary functional structure of software executed by the CPU 11 of the personal computer 1 of FIG. 2.

A tune structure analysis unit 31 performs a predetermined process to analyze the waveform of the tune (which involves a modulation).

The tune structure analysis unit 31 includes a beat feature extraction section 41, an autocorrelation map generation section 42, a segmentation section 43, a music feature extraction section 44, and a chorus identification section 45.

The beat feature extraction section 41 performs a beat feature extraction process to extract beat features, which are features to be extracted on a beat-by-beat basis. The beat feature extraction section 41 supplies the extracted beat features to the beat feature removal section 42. The details of the beat feature extraction process will be described later.

The beat, feature removal section 42 removes a phase component from each of the beat features supplied from the beat feature extraction section 41. The beat feature removal section 42 supplies, to the autocorrelation map generation section 43, the beat features amounts from which the phase components have been removed.

Based on the beat features from which the phase components have been removed, which have been supplied from the beat feature removal section 42, the autocorrelation map generation section 43 performs an autocorrelation map generation process to generate an autocorrelation map. The autocorrelation map generation section 43 supplies the generated autocorrelation map to the segmentation section 44. The details of the autocorrelation map generation process will be described later.

Based on the autocorrelation map supplied from the autocorrelation map generation section 43, the segmentation section 44 performs separation (segmentation) so that the tune is separated into sections each corresponding to one of identical phrases that are repeated a plurality of times by the waveform of the tune.

The music feature extraction section 45 extracts a music feature, which is a musical feature, from each of the separated sections (i.e., partial waveforms of the tune corresponding to the respective separated sections) each corresponding to one of the identical (similar) phrases. The music feature extraction section 45 supplies the extracted music features to the chorus identification section 46.

The music feature extraction section 45 also extracts another feature than the music feature from each of the separated sections (i.e., the partial waveforms of the tune corresponding to the respective separated sections) each corresponding to one of the identical (similar) phrases. The music feature extraction section 45 supplies the other features extracted to the chorus identification section 46.

Based on the music features and the other features supplied from the music feature extraction section 45, the chorus identification section 46 identifies a section corresponding to a chorus of the tune from among the separated sections (i.e., the partial waveforms of the tune corresponding to the respective separated sections) each corresponding to one of the identical (similar) phrases.

Mote that, in the present embodiment, since the personal computer 1 has the above-described hardware configuration of FIG. 2, the tune structure analysis unit 31 is formed as application software to be executed by the CPU 11 as illustrated in FIG. 2, for example. However, with a different hardware configuration of the personal computer 1 from that of FIG. 2, the tune structure analysis unit 31 may alternatively be formed as a hardware unit or a combination of software and hardware components.

As described above, analysis of the structure of the tune based on the waveform of the tune makes it possible to identify the chourusesection of the tune. Therefore, next, with reference to a flowchart of FIG. 4, a chorus identification process performed by the tune structure analysis unit 31 will now be described below.

At step S1, the tune structure analysis unit 31 detects the beats from the waveform of the tune. For example, at step S1, the tune structure analysis unit 31 detects a tempo, a meter, positions of measures, etc., from the waveform of the tune that is reproduced from an audio signal obtained by audio compression according to an MP3 (MPEG Audio Layer-3) system, an AAC (Advanced Audio Coding) system, or the like.

Figure 5:
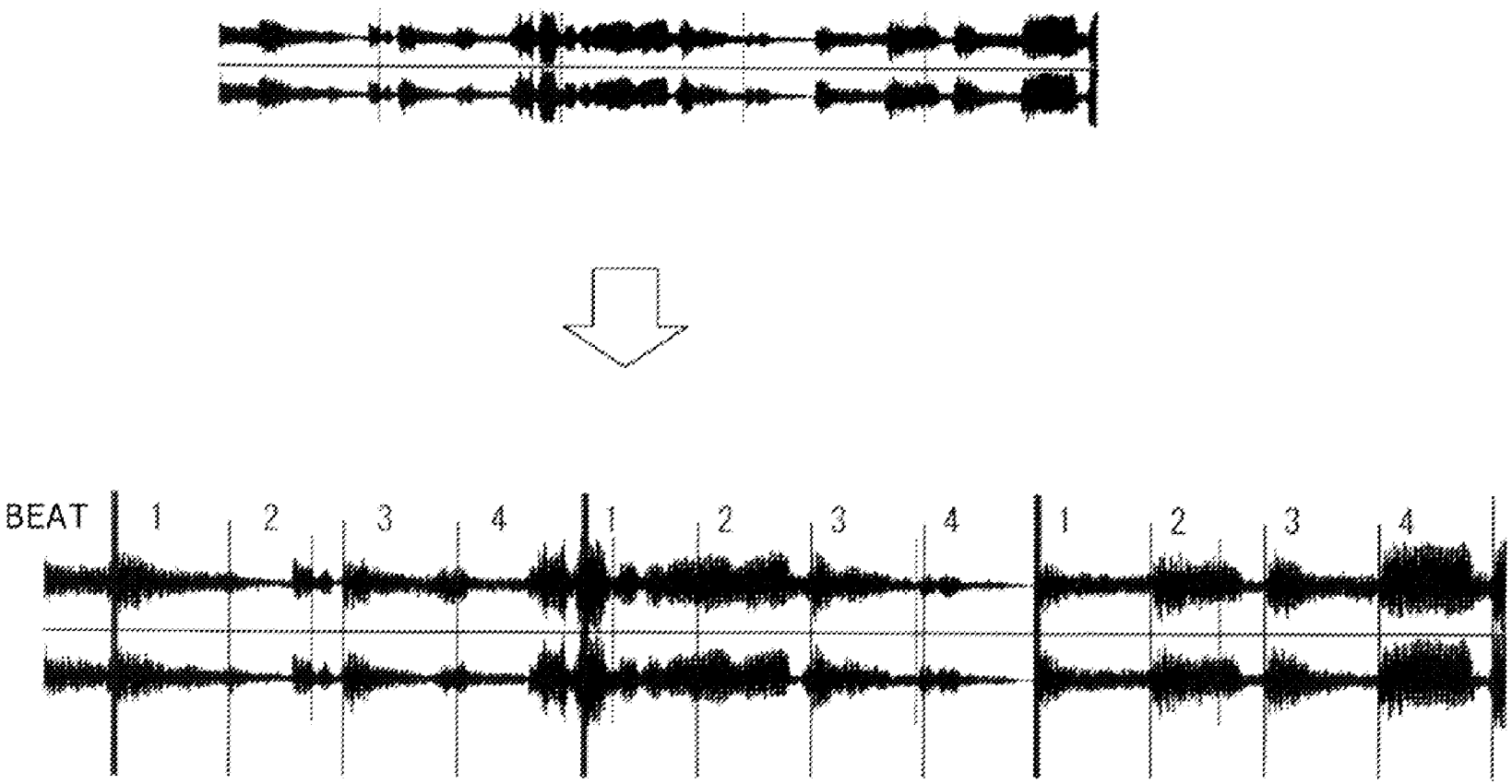
FIG. 5 is a diagram illustrating an example of beats detected from a waveform of a tune.

FIG. 5 is a diagram illustrating an example of the beats detected from the waveform of the tune.

The beats detected from the waveform of the tune illustrated in the upper portion of FIG. 5 are represented in the lower portion of FIG. 5 by sections that are partitioned by vertical lines that separates the waveform of the tune into a plurality of parts. Specifically, of these lines, bold lines with three lines therebetween indicate tops of the measures, while each of four sections that are contained in each section partitioned by the bold lines and which are partitioned by thin lines represents the tempo (i.e., a duration of a quarter note). That is, the waveform of the tune as illustrated in FIG. 5 represents a 4-beat tune, as shown by numbers (1 to 4) that are assigned to each section partitioned by the lines that separates the waveform as illustrated in the lower portion of the figure.

That is, for example, as illustrated in FIG. 5, the tune structure analysis unit 31 detects the beats as illustrated in the lower portion of the figure from the waveform of the tune as illustrated in the upper portion of the figure.

Figure 4:
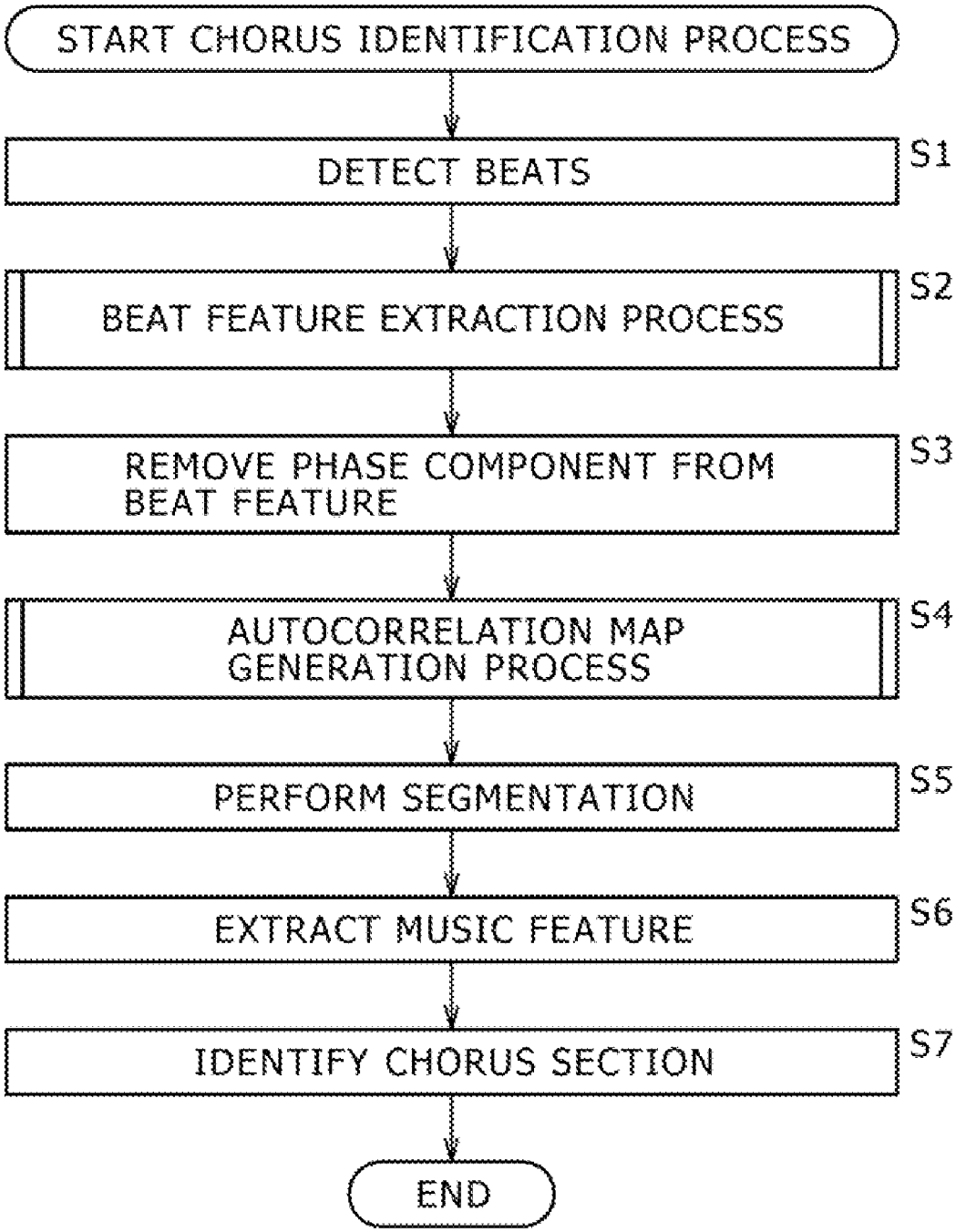
FIG. 4 is a flowchart for explaining a process of extracting a chorus performed by a tune structure analysis unit.

Returning to the flowchart of FIG. 4, at step S2, the beat feature extraction section 41 performs the beat feature extraction process to extract the beat features.

Figure 6:
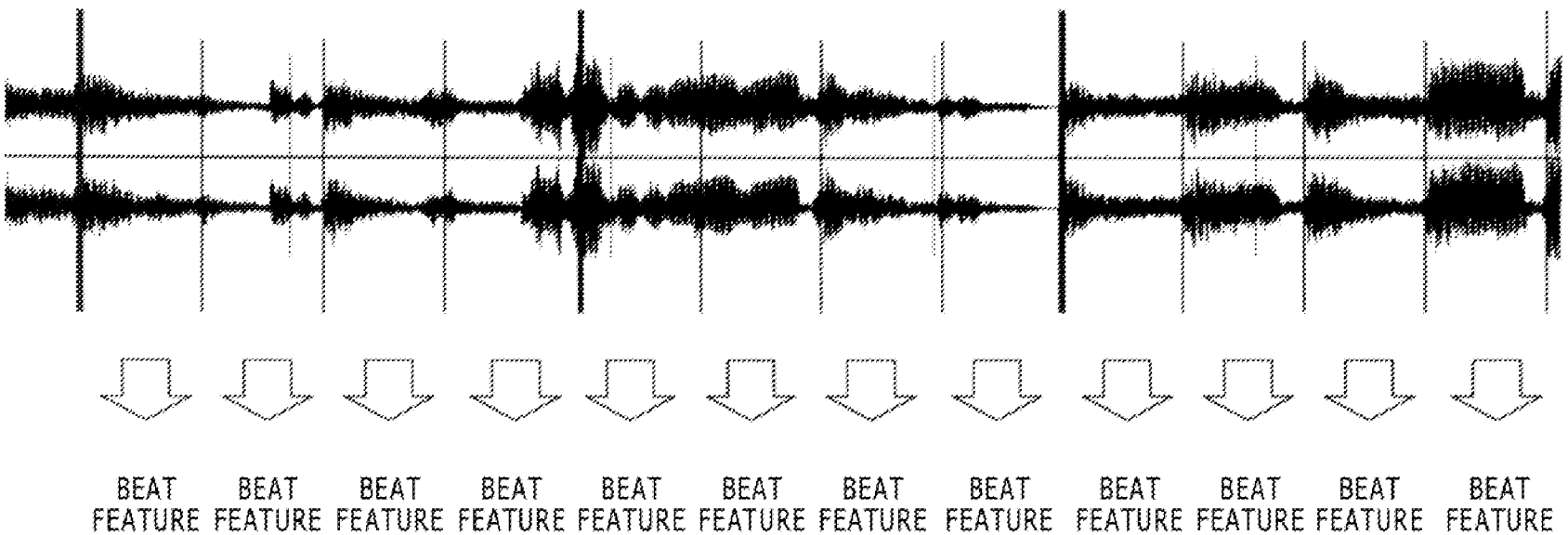
FIG. 6 is a diagram for explaining a beat feature extracted from each beat of the waveform of the tune.

FIG. 6 is a diagram for explaining the beat features extracted on a beat-by-beat basis from the waveform of the tune.

In the waveform of the tune as illustrated in FIG. 6, as with that of the lower portion of FIG. 5, the waveform of the tune is separated into parts each corresponding to each beat (in an example as illustrated in FIG. 6, twelve sections as separated are shown). The beat feature extraction section 41 extracts the beat feature from each of the thus separated beats.

Here, the details of the beat feature extraction process performed by the beat feature extraction section 41 at step S2 will now be described below with reference to a flowchart of FIG. 7.

At step S11, based on the tune waveform separated into the parts each corresponding to each beat, the beat feature extraction section 41 calculates, with respect to each beat, an energy of each tone in the range of seven octaves, for example.

FIG. 3 is a diagram for explaining the beat feature extraction process performed by the beat feature extraction section 41.

As illustrated, in FIG. 8, in the case where the energy of each tone in the range of seven octaves is calculated, for example, energies of chords C, C#, D, D#, E, F, F#, G, G#, A, A#, and B of each of Octaves 1 to 7 (hereinafter also referred to as "O1" to "O7", respectively) are calculated. Here, each of the octaves includes twelve tones (sounds): in ascending order of their frequencies, C (Do), C#, D (Re), D#, E (Mi), F (Fa), F#, G (Sol), G#, A (La), A#, and B (Si). For example, the twelve tones C, C#, D, D#, E, F, F#, G, G#, A, A#, and B of Octave 1 (i.e., O1) are referred to as "C1", "C#1", "D1", "D#1", "E1", "F1", "F#1", "G1", "G#1", "A1", "A#1", and "B1", respectively; the twelve tones C, C#, D, D#, E, F, F#, G, G#, A, A#, and B of Octave 2 (i.e., O2) are referred to as "C2", "C#2", "D2", "D#2", "E2", "F2", "F#2", "G2", "G#2", "A2", "A#2", and "B2", respectively. The same notation is also applied to Octave 3 (i.e., O3) to Octave 7 (i.e., O7).

That is, based on the tune waveform separated into the parts each corresponding to each beat, the beat feature extraction section 41 calculates the respective energies of O1 to B7, for example.

As to a method, for calculating the energies of the tones (O1 to B7) in the range of seven octaves, the energy of each tone is calculated by, for example, analyzing the tune waveform separated into the parts each corresponding to each beat in terms of pitch and time. Next, with reference to FIGS. 9 and 10, the method for calculating the energy of each tone in the range of seven octaves will now be described below.

Figure 9:
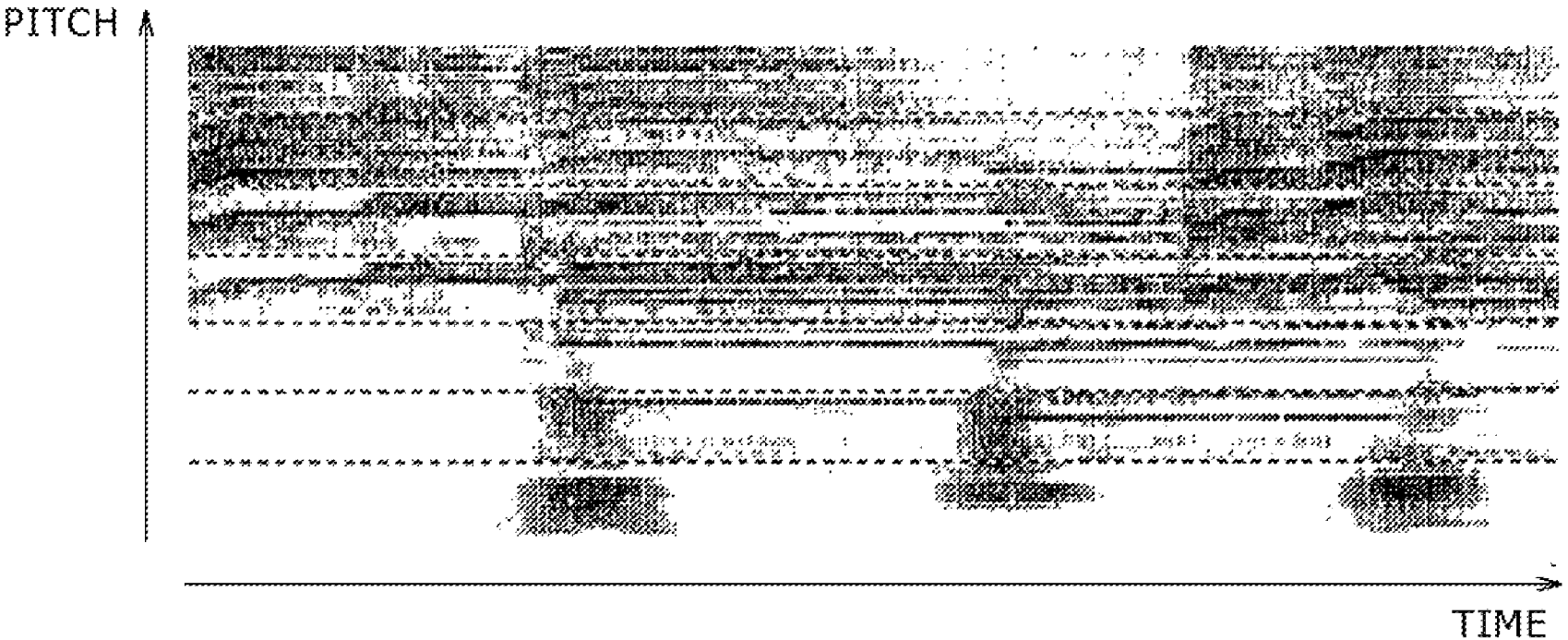
FIG. 9 is a diagram illustrating an exemplary distribution of energies of tones (C1 to B7) over pitch and time.

FIG. 9 is a diagram illustrating an exemplary distribution of the energies of the tones (C1 to B7) over pitch and lime.

In an example as illustrated in FIG. 9, a horizontal axis represents time, and time progresses from the left of the diagram to the right. A vertical axis represents the pitch, and the pitch (i.e., the frequency) increases with increasing height.

The figure includes areas in black and areas in white. The areas in black represent more intense energy, while the areas in white in the figure represent less intense energy. Note that, in the example of FIG. 9, in order to facilitate explanation, the intensity of the energy is expressed by the two colors, black and white. However, in practice, distribution of the intensity of the energy may be expressed more minutely.

Six horizontal dotted lines in the figure are drawn to facilitate explanation, and each of seven sections separated by these dotted lines represents one octave. That is, the seven octaves O1 to O7 are represented by the seven separated sections.

For example, referring to the example as illustrated in FIG. 9, in each of the first to third sections from the bottom of the figure, i.e., O1 to O3, the energies of the tones are distributed sparsely, whereas in each of the fourth to seventh sections from the bottom of the figure, i.e., O4 to O7, the energies of the tones are distributed almost throughout.

Figure 10:
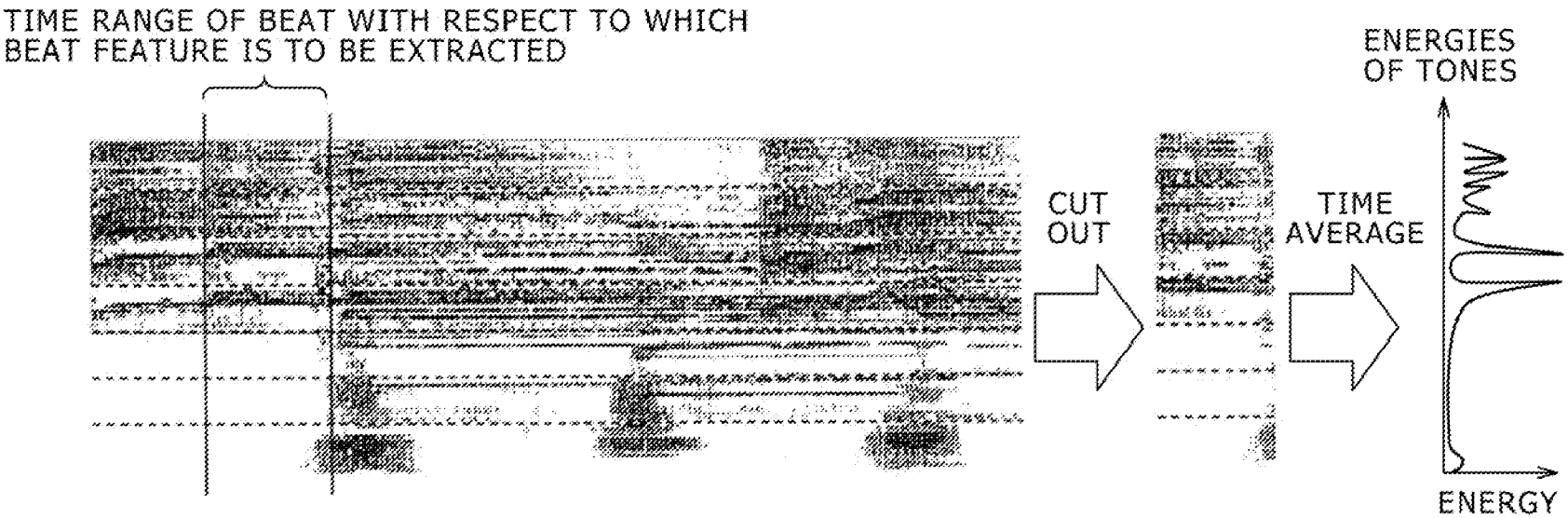
FIG. 10 is a diagram for explaining a method for analyzing the energies of the tones in seven, octaves.

In the case where the energies over the seven-octave range are calculated on a beat-by-beat basis, as illustrated in FIG. 10, the beat feature extraction section 41 cuts out a signal within a time range of a beat with respect to which the beat feature is to be extracted, and averages the energy of the cut out signal by time. As a result, the beat feature extraction section 41 obtains the energies of the tones (C1 to B7) as represented by a graph on the right-hand part of FIG. 10.

Figure 7:
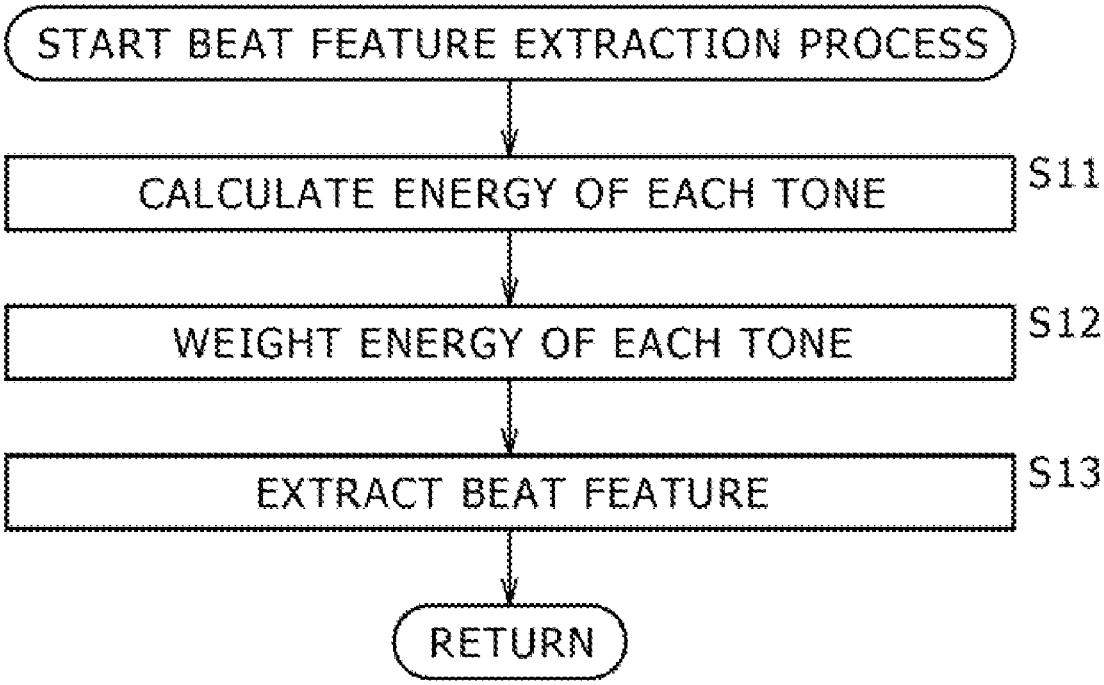
FIG. 7 is a flowchart for explaining the details of a beat feature extraction process performed by a beat feature extraction section.

Returning to the flowchart of FIG. 7, at step S12, the beat feature extraction section 41 weights the calculated energy of each tone. For example, at step S12, the beat feature extraction section 41 weights the calculated energy of each of the tones (C1 to B7) in the seven-octave range in a manner as illustrated in FIG. 8.

As to a method for weighting the energy of each of the tones (C1 to B7), the beat feature extraction section 41 calculates weights by a Gaussian distribution or the like, for example, and, by normalizing the calculated weights, identifies a weight for each of the tones (C1 to B7) and assigns the weight to the tone.

Specifically, the weights W (N) by the Gaussian distribution are calculated using formula (1).

$$W(N)=\mathrm{Exp}(-(N-Gm)\times(N-Gm)/(2\times Gv\times Gv)) \quad (1)$$

In formula (1), Gm denotes a tone with the highest weight, and Gv denotes a width of the weights, and predetermined values are set for them. In addition, N denotes the number of tones; therefore, the number of weights W (N) calculated by the Gaussian distribution is the same as the number of tones (in the case of FIG. 8, for example, C1 to B7). Then, the calculated weights W (M) are normalized.

Assigning the weights to the tones (C1 to B7) in the above-described manner contributes to removing irrelevant tones, such as tones in high frequency bands and tones in low frequency bands, for example.

Returning to the flowchart of FIG. 7, at step S13, the beat feature extraction section 41 extracts the beat, features, and the beat feature extraction process is completed.

Figure 8:
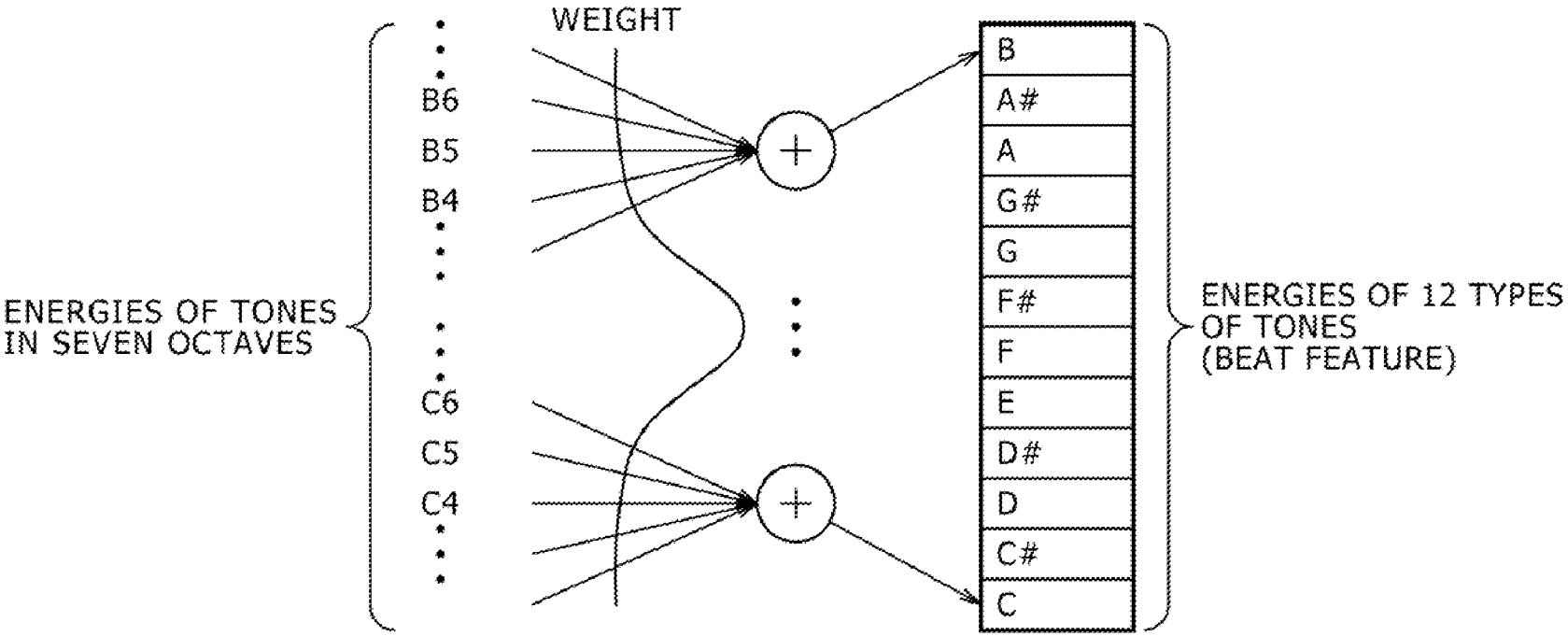
FIG. 8 is a diagram for explaining the beat feature extraction process performed by the beat feature extraction section.

For example, at step S13, as illustrated in FIG. 8, the beat feature extraction section 41 extracts the energy of the chord C by, out of C1 to B7 as weighted, adding those of C1, C2, C3, C4, C5, C6, and C7 together, and extracts the energy of the chord C# by adding those of C#1, C#2, C#3, C#4, C#5, C#6, and C#7 together. Similarly, the beat feature extraction section 41 extracts the energy of the chord D by, out of C1 to B7 as weighted, adding those of D1 to D7 together, and extracts the energy of the chord D# by adding those of D#1 to D#7 together. As to E1 to B7, similar addition is carried out to extract the energies of the respective chords E to B. Thus, the beat feature extraction section 41 extracts the energies of the twelve types of tones C, C#, D, D#, E, F, F#, G, G#, A, A#, B as the beat feature, as illustrated in FIG. 8.

That is, by performing the processes of step S11 to step S13, the beat feature extraction section 41 calculates the beat feature of each of the separated sections of the tune waveform, each corresponding to each beat.

Note that the beat feature extracted by the beat-feature extraction section 41 is not limited to the above-described example. For example, the 84 (12×7) energies as they are may be used without carrying out the adding process in the process of step S13. In short, any feature is applicable as the beat feature as long as it is extracted with respect to each of the separated sections each corresponding to each beat.

Returning to the flowchart of FIG. 4, at step S3, the beat feature removal section 42 removes the phase components from the beat features supplied from the beat feature extraction section 41, and supplies the resulting beat features, from which the phase components have been removed, to the autocorrelation map generation section 43.

For example, at step S3, the beat feature removal section 42 identifies, from among the tune waveform separated into the parts each corresponding to each beat, sections for which correlation calculation is to be performed. The beat feature removal section 42 subjects the extracted beat features of the identified sections to a discrete Fourier transform (DFT) to remove the phase components from the extracted beat features.

Figure 11:
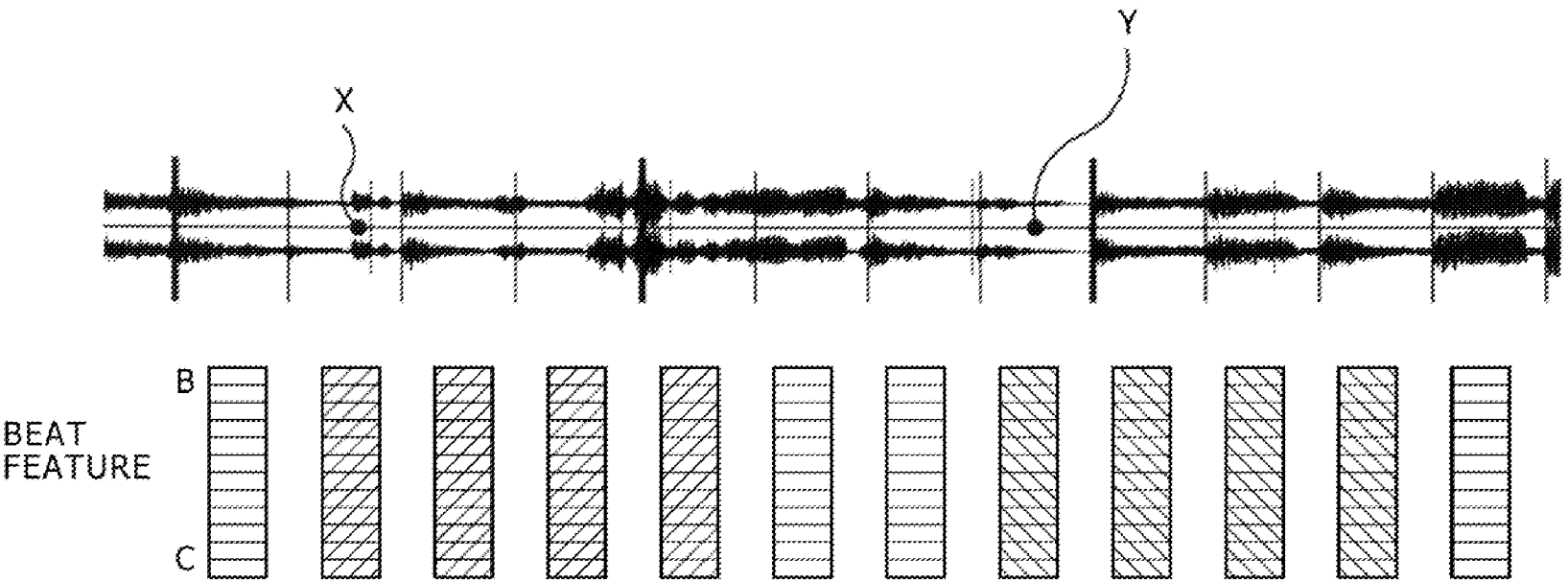
FIG. 11 is a diagram for explaining a correlation between one beat feature and another beat feature.

FIG. 11 is a diagram for explaining the correlation between one beat feature and another beat feature.

In an example as illustrated in FIG. 11, each of the beat features of the tune waveform separated into the parts each corresponding to each beat is represented by twelve rectangles shown below the tune waveform, and the twelve rectangles represents the chords of the twelve types of tones C, C#, D, D#, E, F, F#, G, G#, A, Air, and B, respectively (in the example of FIG. 11, chord names of only C and B are shown).

Suppose, for example, that, in connection with a waveform of a certain tune, the correlation between a section including position X (i.e., the beat feature of this section) and a section including position (i.e., the beat feature of this section) (i.e., the correlation between two different sections) is to be calculated. In this case, the correlation between the beat features of four sections (i.e., four beats) that extend backward in time from the section including position X and which are hatched by rising oblique lines in the figure and the beat features of four sections (i.e., four beats) that extend backward in time from the section including position Y and which are hatched by falling oblique lines in the figure is calculated.

In this case, for example, the beat feature removal section 42 subjects both of the beat features of the four sections hatched by the rising inclined lines in the figure and the beat features of the four sections hatched by the falling oblique lines in the figure, for which the correlation calculation is to be performed, to the discrete Fourier transform, thereby removing the phase components from those beat features.

Figure 12:
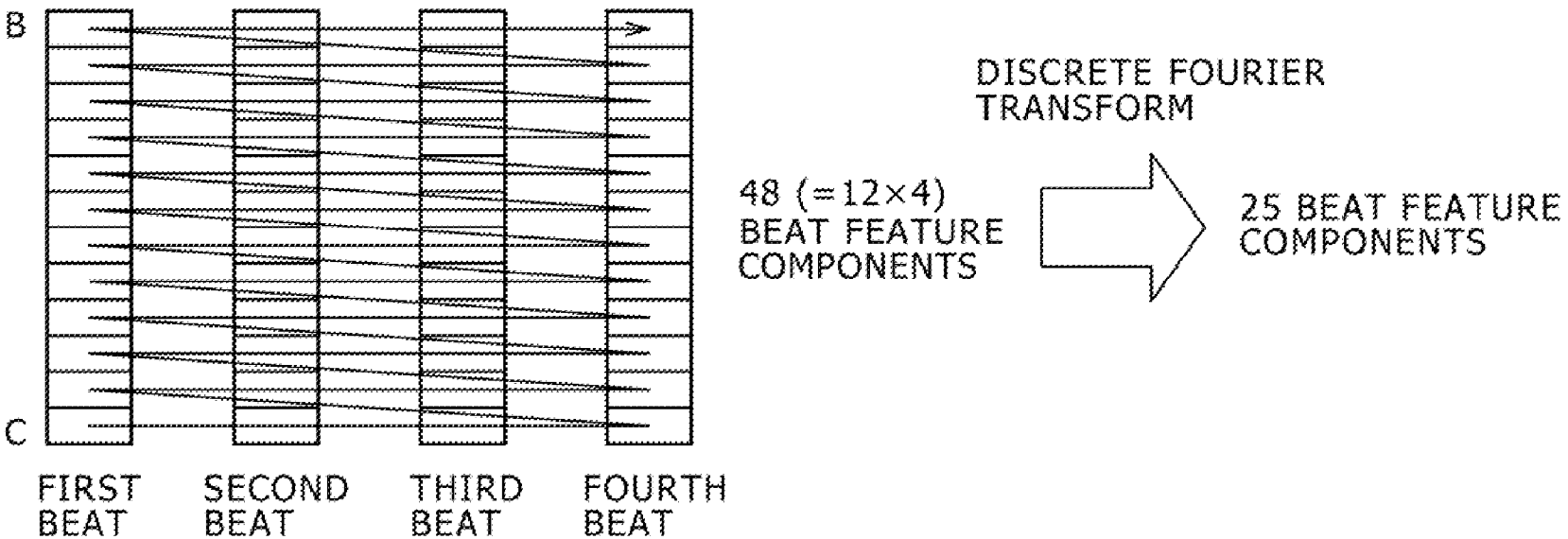
FIG. 12 is a diagram for explaining a process of removing of the beat feature.

That is, for example, as illustrated in FIG. 12, the beat feature removal section 42 subjects the beat features of the four sections (i.e., four beats) hatched by the rising inclined lines in FIG. 11 to the discrete Fourier transform to remove the phase components therefrom. This transform reduces the number of beat feature components from 48 (12 (components)×4 (sections)) to 25 (12×4/2+1).

Similarly, for example, the beat feature removal section 42 subjects the beat features of the four sections (i.e., four beats) hatched by the falling inclined lines in FIG. 11 to the discrete Fourier transform to remove the phase components therefrom. As a result, the number of beat feature components is reduced from 48 to 25.

Figure 13:
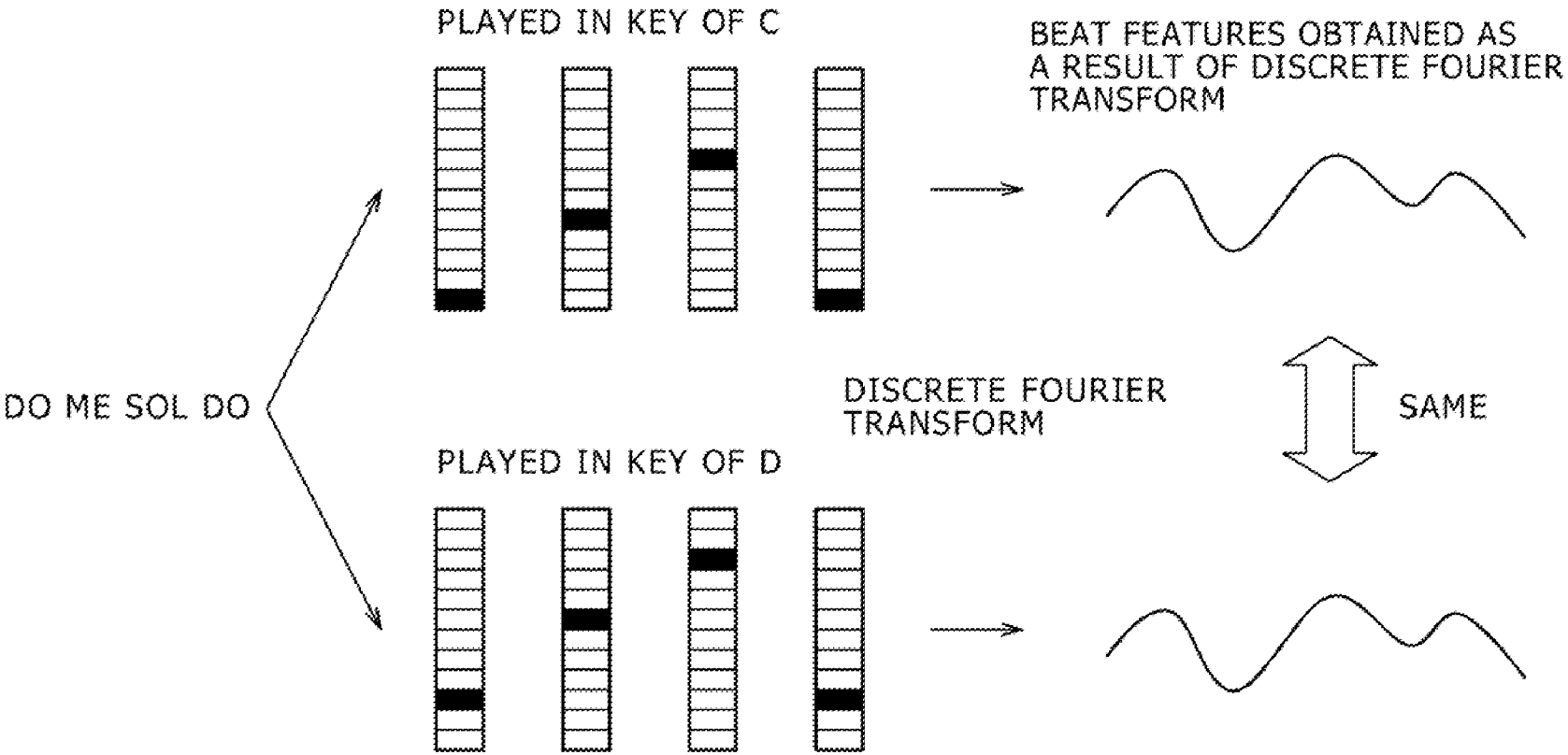
FIG. 13 is a diagram for explaining the process of removing of the beat feature.

At this time, referring to FIG. 13, in the case where "Do" "Me" "Sol" "Do" are played in the key of C and in the key of D (which is raised by two as compared to the key of C), for example, the beat features (e.g., the beat feature components) obtained as a result, of the discrete Fourier transform are constant regardless of whether the key is C or D. That is, in the tune that involves a modulation, the beat features obtained as a result of the discrete Fourier transform are constant regardless of the modulation. Therefore, by calculating the correlation between one set of the 25 beat feature components and the other once, the correlation calculation is achieved while the modulation is handled well enough. This reduces the amount of operation related to the correlation, and therefore, the analysis of the waveform of the tune involving the modulation is achieved with a reduced operation amount.

Note that the number of sections selected when calculating the correlation between the beat features is not limited to four (four beats) as in the above-described example, but may be one, eight, or ten, for example. Also note that it is not essential that the selected sections extend backward in time from the reference position (e.g., X or Y in FIG. 11). Alternatively, the selected sections may extend forward or both forward and backward. That is, referring to FIG. 11, the sections selected when calculating the correlation between the beat features may, for example, be the beat features of three sections (three beats) that extend forward of the section including position X and six backward sections (six beats), i.e., a total of eight sections (eight beats).

Also note that in the above-described example, the beat feature removal section 42 uses the discrete Fourier transform to remove the phase components from the bear, features. However, the present invention is not limited to this example. Any method is applicable as long as it is able to remove the phase components from the beat features.

Returning to the flowchart of FIG. 4, at step S4, based, on the beat features from which the phase components have been removed and which are supplied from the beat feature removal section 42, the autocorrelation map generation section 43 performs the autocorrelation map generation process to generate the autocorrelation map.

Here, with reference to the flowchart of FIG. 14, the details of the autocorrelation map generation process performed by the autocorrelation map generation section 43 at step S4 will now be described below.

At step S21, the autocorrelation map generation section 43 calculates the correlation between the beat features of the four sections (i.e., the sections hatched by the rising oblique lines in FIG. 11) including position X whose phase components have been removed and the beat features of the four sections (i.e., the sections hatched by the failing oblique lines in FIG. 11) including position Y whose phase components have been removed, which are both supplied from the beat feature removal section 42.

In other words, in order to handle the tune involving the modulation, the autocorrelation map generation section 43 uses only a norm component of the discrete Fourier transformed beat features of several beats to calculate the correlation.

Specifically, the correlation between the beat features is calculated using formula (2), for example.

[Equation 1]

$$Pearson(X, Y) = \frac{\frac{1}{n-1}\sum_{i=1}^{n}(X_i - \overline{X})(Y_i - \overline{Y})}{\sqrt{\frac{1}{n-1}\sum_{i=1}^{n}(X_i - \overline{X})^2}\sqrt{\frac{1}{n-1}\sum_{i=1}^{n}(Y_i - \overline{Y})^2}} \quad (2)$$

In formula (2), for example, X denotes the beat features of the four sections (four beats) including position X in FIG. 11 whose phase components have been removed, and Y denotes the beat features of the four sections (four beats) including position Y in FIG. 11 whose phase components have been removed.

At step S22, based on the calculated correlation between each beat, the autocorrelation map generation section 43 generates the autocorrelation map.

Figure 15:
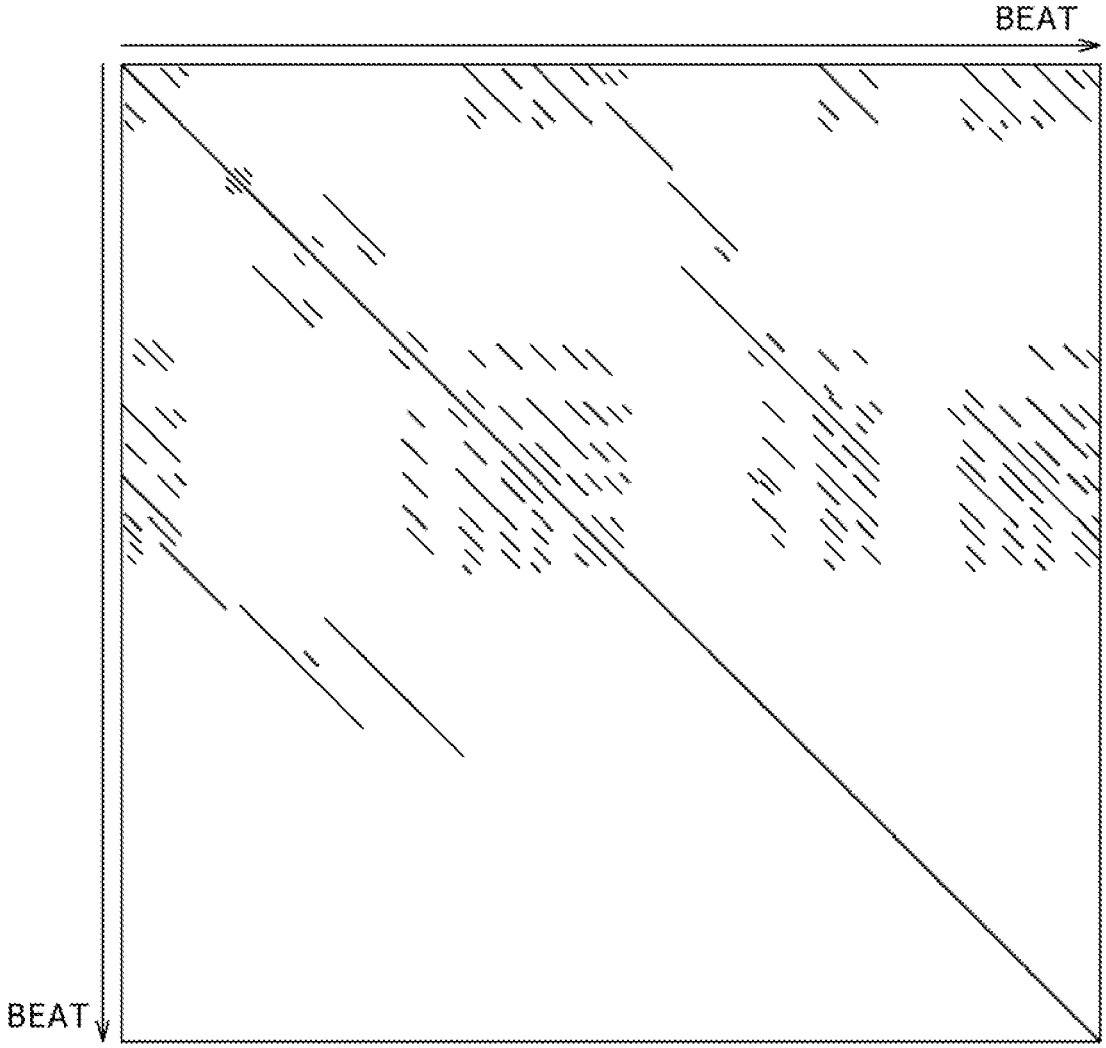
FIG. 15 is a diagram illustrating an exemplary autocorrelation map generated by the autocorrelation map generation section.

FIG. 15 is a diagram illustrating an exemplary autocorrelation map generated by the autocorrelation map generation section 43.

In the exemplary autocorrelation map as illustrated in FIG. 15, a horizontal axis represents the beats of the whole of a tune, and time progresses from the left of the diagram to the right. A vertical axis represents the beats of the whole of the same tune as that represented by the horizontal axis, and time progresses from the top to the bottom of the diagram. That is, regarding the horizontal axis, as the horizontal position moves rightward in the diagram, the represented position in the tune approaches the end of the tune, whereas regarding the vertical axis, as the vertical position moves downward in the diagram, the represented position in the tune approaches the end of the tune. Because the horizontal axis and the vertical axis represent the beats of the same tune, the two axes have the same length.

Areas in black in the figure indicate that the correlation between the corresponding beats of the tune identified by the horizontal and vertical axes is high, whereas areas in white in the figure indicate that the correlation between the corresponding beats of the tune identified by the horizontal and vertical axes is low. A diagonal that extends from the top left corner to the bottom right corner of the autocorrelation map represented by a square in the figure corresponds to positions where the beat of the tune identified by the horizontal axis is identical to the beat identified by the vertical axis. Therefore, the diagonal is naturally represented by a black line (diagonal) in the figure, indicating a high correlation.

That is, based on the correlations between the beat features calculated by formula (2), for example, the exemplary autocorrelation map of FIG. 15 indicates positions where the correlation between the corresponding beats is high by the black color and positions where the correlation between the corresponding beats is low by the white color. In other words, the autocorrelation map is a diagram that indicates portions of the tune that have similar phrases (i.e., portions with high correlation) by black lines.

Returning to the flowchart of FIG. 4, at step 35, based on the autocorrelation map supplied from the autocorrelation map generation section 43, the segmentation section 44 performs the separation (i.e., the segmentation) so that the tune is separated into sections each corresponding to one of identical phrases (similar phrases) that are repeated a plurality of times by the tune waveform.

Figure 16:
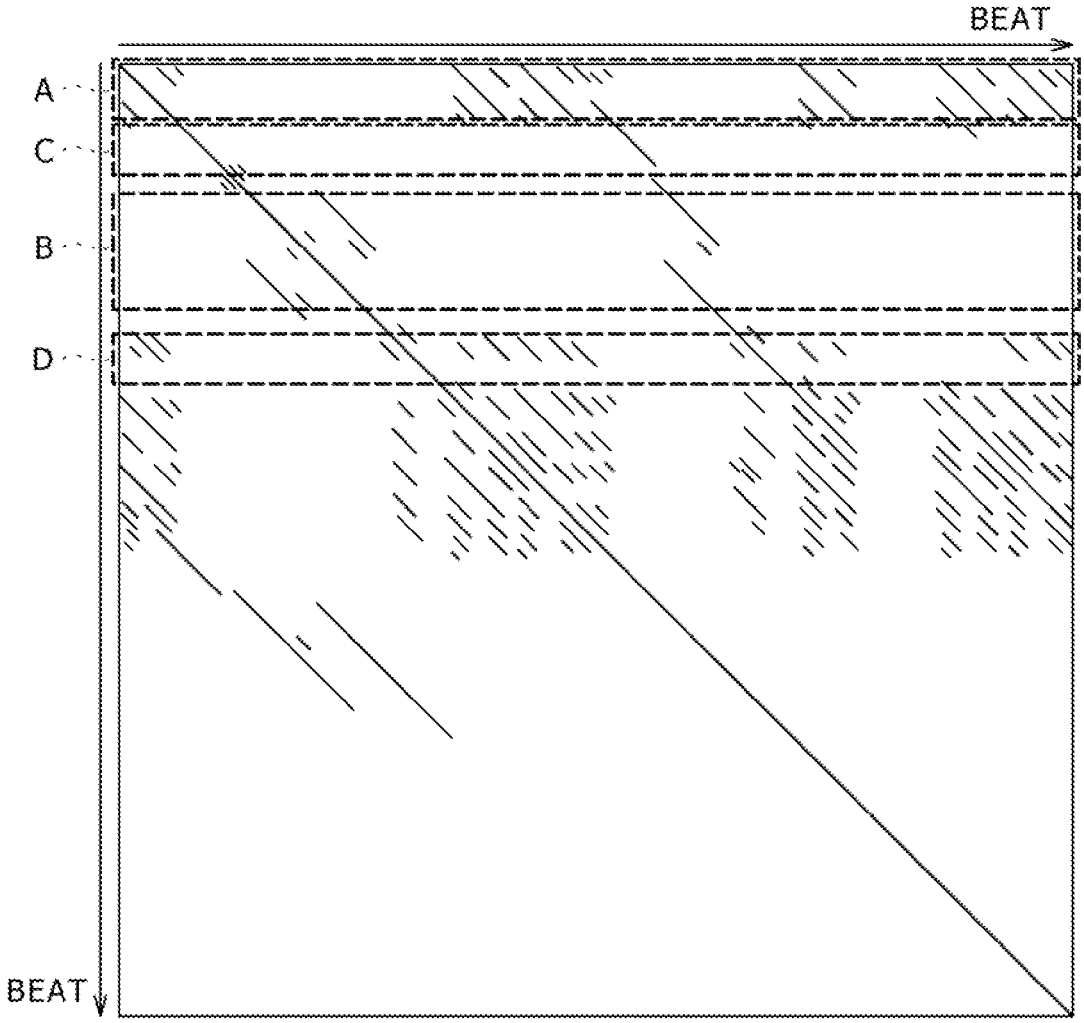
FIG. 16 is a diagram for explaining separation of sections in the autocorrelation map.

Specifically, referring to an example of FIG. 16, in the exemplary autocorrelation map of FIG. 15, a substantially identical (similar) falling-oblique-line pattern appears four times in the topmost area enclosed by a dotted line A, and sections where this pattern appears are denoted as "section A". In an area (second from the top) enclosed by a dotted line C, a substantially identical falling-oblique-line pattern appears twice, and sections where this pattern appears are denoted as "section C". Similarly, in an area (third from the top) enclosed by a dotted line B, a substantially identical falling-oblique-line pattern appears twice, and sections where this pattern appears are denoted as "section B". In an area (fourth from the top) enclosed by a dotted line D, a substantially identical falling-oblique-line pattern appears twice, and sections where this pattern appears are denoted as "section D". Although not shown in the figure, further sections where substantially identical falling-oblique-line patterns appear are similarly denoted as "section E", "section F", "section G", and so on.

Figure 17:
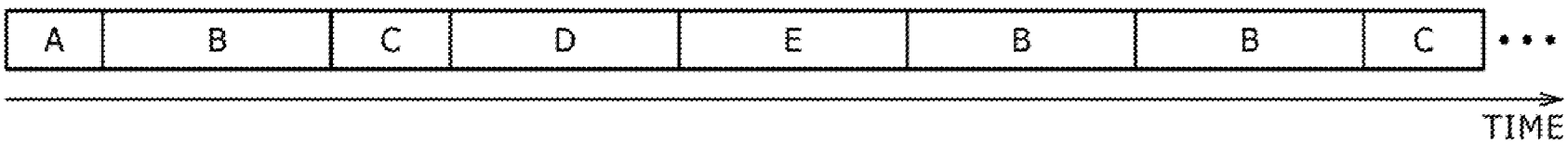
FIG. 17 is a diagram for explaining separation of sections in the tune.

An expression of FIG. 17 is obtained by expressing the autocorrelation map of FIG. 16 separated in the above-described manner into sections, each corresponding to one of the similar phrases that are repeated a plurality of times, in accordance with the beats of the tune represented by the horizontal axis of FIG. 16. That is, FIG. 17 shows the tune (i.e., the waveform of the tune) as separated into the sections each corresponding to one of the similar phrases.

In FIG. 17, the tune is separated into the sections, in order, A, B, C, D, E, B, B, C, etc., in accordance with the sections obtained by the separation in FIG. 16. Time progresses from the left of the diagram to the right, and longer sections indicate longer playing time while shorter sections indicate shorter playing time.

Returning to the flowchart of FIG. 4, at step S6, the music feature extraction section 45 extracts the music feature from each of the separated sections (i.e., the partial waveforms of the tune corresponding to the respective separated sections) each corresponding to one of the identical (similar) phrases, and supplies the extracted music features to the chorus identification section 46.

Here, the music features extracted by the music feature extraction section 45 are musical features, such as information concerning volume or a sound source, a gain of a certain frequency band, a frequency balance, a diversity of tones, a proportion of rhythm instruments such as drums and a bass, or whether a vocal exists.

Figure 18:
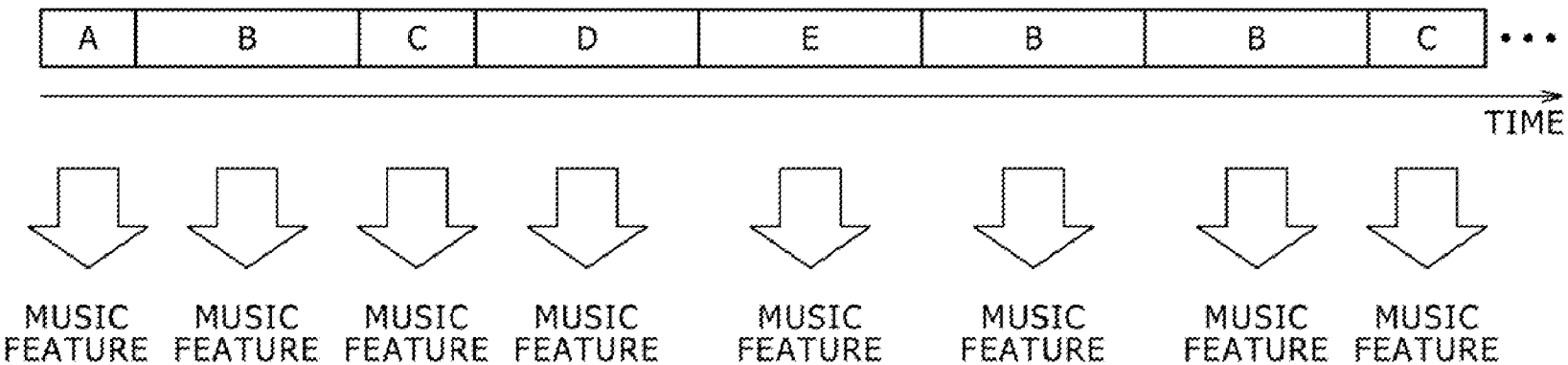
FIG. 18 is a diagram for explaining a music feature extracted from each of the separated sections of the tuns waveforms.

FIG. 18 is a diagram for explaining the music features extracted from each, of the separated sections of the tune waveform.

The separated sections as illustrated in FIG. 18 are, as with FIG. 17, separated in accordance with the sections obtained by separating the autocorrelation map of FIG. 16 (the separated sections are arranged in the following order: A, B, C, D, E, B, B, C, and so on), and the music feature extraction section 45 extracts from each of the separated sections the music feature such as the volume, for example.

Returning to the flowchart of FIG. 4, at step S6, the music feature extraction section 45 also extracts the other feature than the music feature from each of the separated sections (i.e., the partial waveforms of the tune corresponding to the respective separated sections) each corresponding to one of the identical (similar) phrases, and supplies the other features extracted to the chorus identification section 46.

Here, the other feature extracted by the music feature extraction section 45 is a feature, such as a length of a particular separated section, the number of times a particular section appears in one tune, or the number of times a particular section is repeated.

Figure 19:
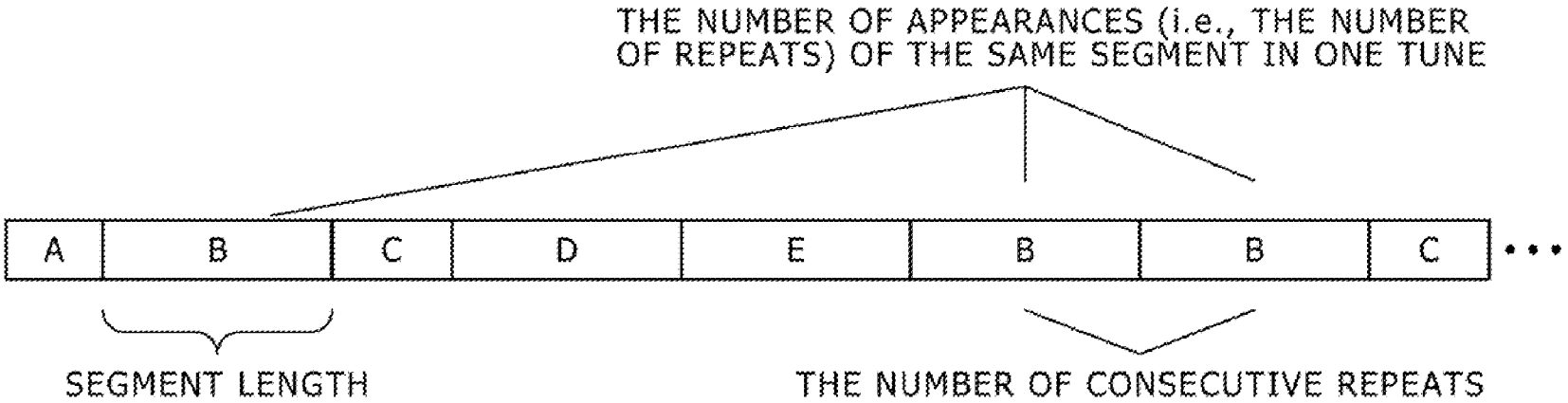
FIG. 19 is a diagram for explaining other features than the music feature extracted from each of the separated sections of the tune.

FIG. 19 is a diagram for explaining the other feature than the music feature extracted from each of the separated sections of the tune.

In an example as illustrated in FIG. 19, the music feature extraction section 45 extracts, as the other features, a "segment length" (measured in beats) such as the length of section B, "the number of appearances (i.e., the number of repeats) of the same segment in one tune" indicating how many times section B appears in one tune, "the number of consecutive repeats" indicating the number of times section 8 is repeated, etc.

Other than the examples described above with reference to FIG. 19, examples of the other features include a relative position of a particular segment in one tune (which is, in the case of a segment, that begins one minute after the start of a tune that is five minutes in length, for example, ⅕-0.2), and the degree of variation of a segment that appears immediately forward or backward.

Extracting more of the music features and the other features allows the chorus identification section 46 to identify the structure of the tune with a more improved precision, for example. Details thereof will be described later.

Note that the music feature extraction section 45 may extract only either one of the music features and the other features from each of the separated sections (i.e., the partial waveforms of the tune corresponding to the respective separated sections) each corresponding to one of the identical (similar) phrases, and supply the extracted music features or other features to the chorus identification section 46.

Returning to the flowchart of FIG. 4, at step S7, based on the music features and/or the other features supplied from the music feature extraction section 45, the chorus identification section 46 identifies the section corresponding to the chorus of the tune from among the separated sections (i.e., the partial waveforms of the tune corresponding to the respective separated sections) each corresponding to one of the identical (similar) phrases. Then, the chorus identification process is completed.

Figure 20:
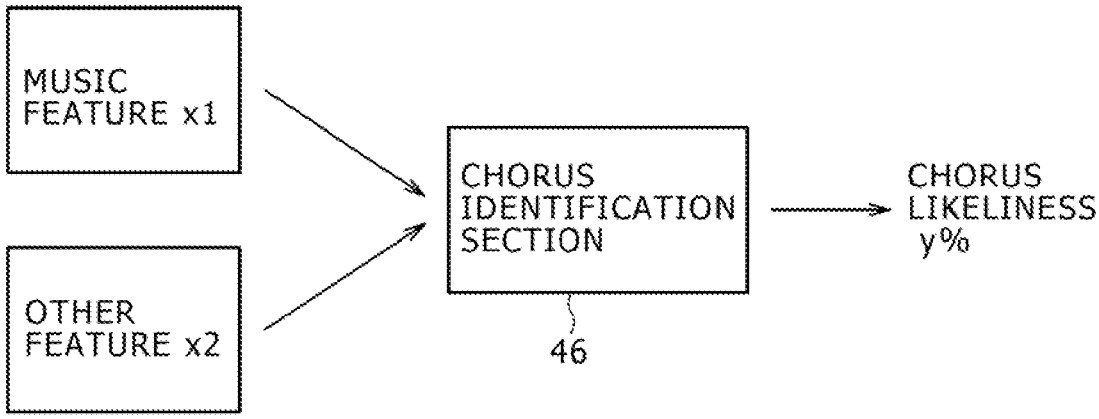
FIG. 20 is a diagram for explaining identification of a section corresponding to a chorus of the tune performed by a chorus identification section.

For example, referring to FIG. 20, at step S7, based on the extracted music feature (X1) and other feature (X2) of each of the separated sections, the chorus identification section 46 calculates a "chorus likeliness" (y(%)) of each section to identify the section corresponding to the chorus of the tune.

Specifically, for example, the chorus identification section 46 performs learning for chorus identification using the music features (X1), the other features (X2), and data concerning a correct chorus (e.g., user-set data that indicates which part of the tune is the chorus of the tune) to generate a specific function (e.g., a function for computing the "chorus likeliness"). The chorus identification section 46 subjects the music features (X1) and the other features (X2) supplied from the music feature extraction section 45 to computation according to the generated specific function to calculate the "chorus likeliness" (y(%)) of each section, thereby identifying the section corresponding to the chorus of the tune.

Note that a method in which the "chorus likeliness" (y(%)) is calculated by the chorus identification section 46 is not limited to the above-described method. Any method is applicable as long as a probability of being the chorus can be calculated.

Figure 21:
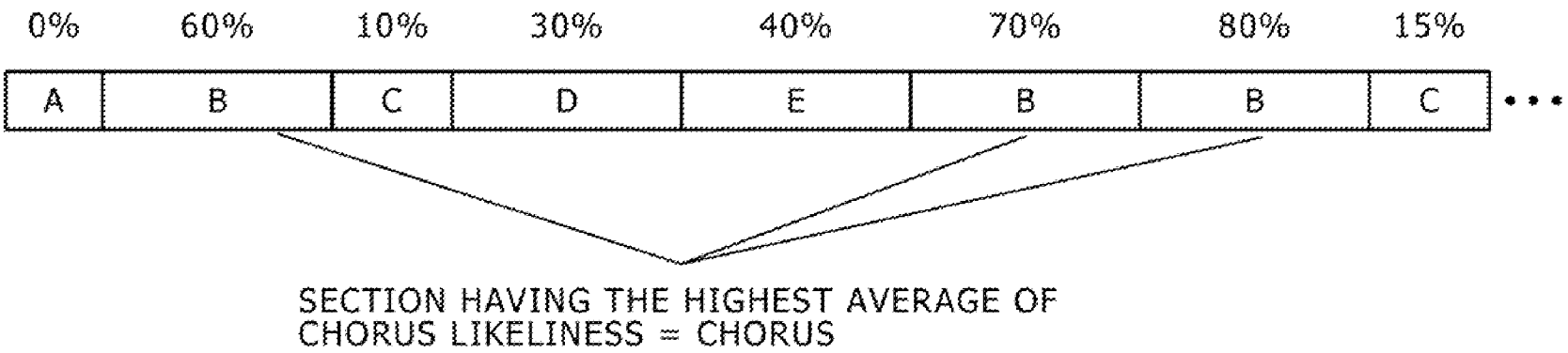
FIG. 21 is a diagram for explaining the details of the identification of the section corresponding to the chorus of the tune performed by the chorus identification section.

FIG. 21 is a diagram for explaining the details of the identification by the chorus identification section 46 of the section corresponding to the chorus of the tune.

In an example as illustrated in FIG. 21, as with FIG. 17 and the like, the tune (i.e., the waveform of the tune) is separated into the sections arranged in the following order: A, B, C, D, E, B, B, C, and so on. The chorus identification section 46 calculates the chorus likeliness of each of the separated sections and obtains, for example, the following results: 0% for "the chorus likeliness of section A"; 60% for "the chorus likeliness of section B"; 10% for "the chorus likeliness of section C"; 30% for "the chorus likeliness of section D"; 40% for "the chorus likeliness of section E"; 70% for "the chorus likeliness of section B"; 80% for "the chorus likeliness of section B"; 15% for "the chorus likeliness of section C"; and so on.

Then, the chorus identification section 46 identifies the section that has the highest average of the calculated "chorus likeliness" as the section corresponding to the chorus of the tune, for example. Because the "chorus likeliness" of sections B is 60%, 70%, 80%, and so on, as illustrated in FIG. 21 and section B has the highest average of the "chorus likeliness", the chorus identification section 46 identifies sections B as the sections corresponding to the chorus of the tune, for example.

In the above-described manner, the tune structure analysis unit 32 is able to recognize the structure of the tune involving the modulation based on the waveform of the tune with a reduced operation amount.

For example, based on waveforms of tunes obtained from: an enormous number of pieces of tune data recorded on the recording section 18 formed by the hard disk or the like of the personal computer 1, sections corresponding to chouruses of the tunes can be identified from the tune structures of the tunes with a reduced operation amount. This makes it possible to play, when selecting a tune, only a chorus of the tune, instead of playing the tune from the beginning. As a result, a user is able to listen to the chouruses (i.e., the most alluring parts) of the tunes to search for a desired tune, for example.

Moreover, because the section corresponding to the chorus of the tune can be identified based on the tune structure of the tune with a reduced operation amount, it, becomes possible to record data of a larger number of tunes on a recording medium of small capacity by recording only the cut-out chourusesections of the tunes, for example.

Sole that the above example has been described with reference to an exemplary case where "Chorus" as a tune structure component is identified based on the waveform of the tune. However, the present invention is not limited to this example. For example, "Introduction", "Interlude", "Verse A", "Verse B", or the like may be identified instead of "Chorus".

Figure 14:
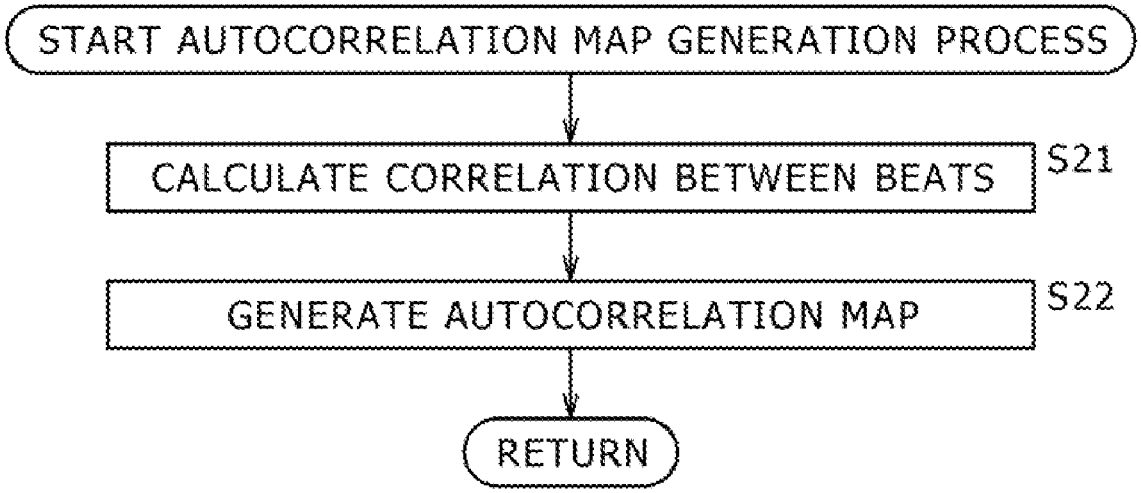
FIG. 14 is a flowchart for explaining the details of an autocorrelation map generation process performed by an autocorrelation map generation section.

Note that the process of generating the autocorrelation map by the autocorrelation map generation section 43 is not limited to the above-described process (the autocorrelation map generation process of FIG. 14). Any method, is applicable as long as the autocorrelation map can be generated based on the beat features from which the phase components have been, removed. For example, in the case where, in the segmentation process performed by the segmentation section 44 in the process of step S5 in FIG. 4, the identification of only the section corresponding to "Chorus" is required (i.e., in the case where there is no need to identify the section corresponding to "Verse A" or "Verse B"), the separation of the tune need not be so minute that any one of the separated sections has a length shorter than can generally be considered as a length of "Chorus". That is, any one of the separated sections need not have a length shorter than that of a predetermined number (e.g., twenty) of beats. In other words, repeats with a length shorter than that of the predetermined number of beats need not be detected from the autocorrelation map. As such, it may be so arranged that the autocorrelation map is first generated with intervals of the predetermined number of beats on one side (e.g., on a vertical axis in FIG. 23 described below), and thereafter, the correlation is calculated only with respect to points preceding or following a point with high correlation (i.e., a point that may involve repeats). This further reduces a load on the process for identifying "Chorus".

Next, with reference to a flowchart of FIG. 22, the details of the autocorrelation map generation process performed by the autocorrelation map generation section 43 at step S4 in FIG. 4 in the case where the identification of only the section corresponding to "Chorus" is required will now be described below.

At step S31, the autocorrelation map generation section 43 calculates the correlations between the beats at intervals of N beats on one side. For example, at step S31, at intervals of N beats on the vertical axis in FIG. 23 described below, the autocorrelation map generation section 43 calculates the correlation between the beat features of the four sections including position X (i.e., the sections hatched by the rising oblique lines in FIG. 11) whose phase components have been removed and the beat features of the four sections including position Y (i.e., the sections hatched by the falling oblique lines in FIG. 11) whose phase components have been removed, which are both supplied from the beat feature removal section 42.

Specifically, the calculation of the correlations between the beat features at intervals of K beats on the vertical axis in FIG. 23 described below is performed using the above-described formula (2), for example.

At step S32, the autocorrelation map generation section 43 generates the autocorrelation map based on the calculated correlations between the beats.

Figure 23:
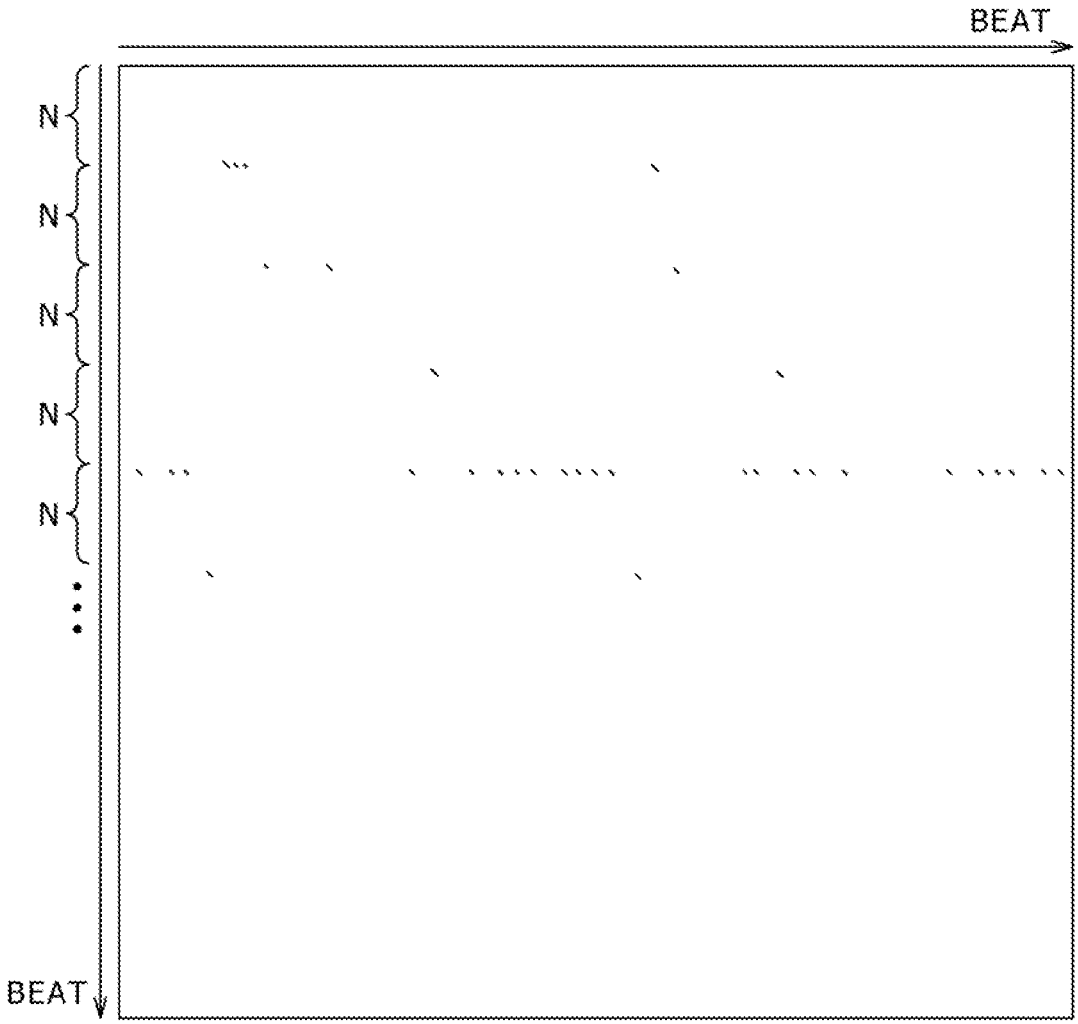
FIG. 23 is a diagram illustrating an exemplary autocorrelation map with intervals of N beats on one side.

FIG. 23 is a diagram illustrating an exemplary autocorrelation map generated by the autocorrelation map generation section 43 with intervals of N beats on one side.

In the exemplary autocorrelation map as illustrated in FIG. 23, as with FIG. 15, a horizontal axis represents the beats of the whole of a tune, whereas the vertical axis represents the beats of the whole of the same tune as that represented by the horizontal axis. Regarding the horizontal axis, as the horizontal position moves rightward in the diagram, the represented position, in the tune approaches the end of the tune, whereas regarding the vertical axis, as the vertical position moves downward in the diagram, the represented position in the tune approaches the end of the tune. Areas in black in the figure indicate that the correlation between the corresponding beats of the tune identified by the horizontal and vertical axes is high, whereas areas in white in the figure indicate that the correlation between the corresponding beats of the tune identified by the horizontal and vertical axes is low.

In the exemplary autocorrelation map of FIG. 23, since the correlations between the beat features are calculated at intervals of N beats on the vertical axis, the high-correlation areas in black appear only at intervals of N beats on the vertical axis. Conversely, in the exemplary autocorrelation map of FIG. 23, the correlations between the beat features are not calculated between one Nth beat and the next Nth beat; therefore, intermediate areas are necessarily white.

That is, in the exemplary autocorrelation map of FIG. 23, the positions indicated by black acts indicate high correlation between the beat features whose phase components have been removed.

Note that, as described above, in the case where the length that can generally be considered as the length of "Chorus" is that of twenty or more beats, for example, the user previously sets N=20 (beats) in the autocorrelation map of FIG. 23.

Figure 22:
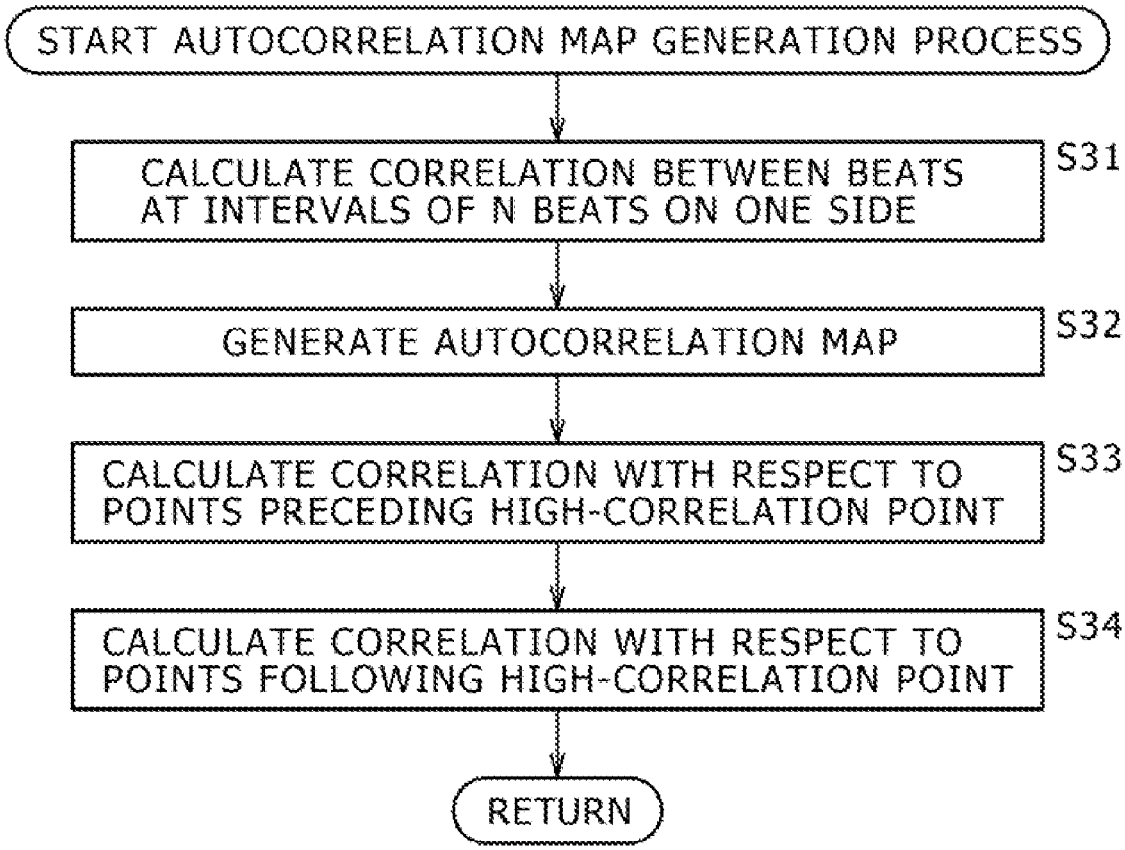
FIG. 22 is a flowchart for explaining the details of the autocorrelation map generation process performed by the autocorrelation map generation section.

Returning to the flowchart of FIG. 22, at step S33, the autocorrelation map generation section 43 calculates the correlation with respect to the points preceding the points for which the correlation has been detected in the generated autocorrelation map.

Figure 24:
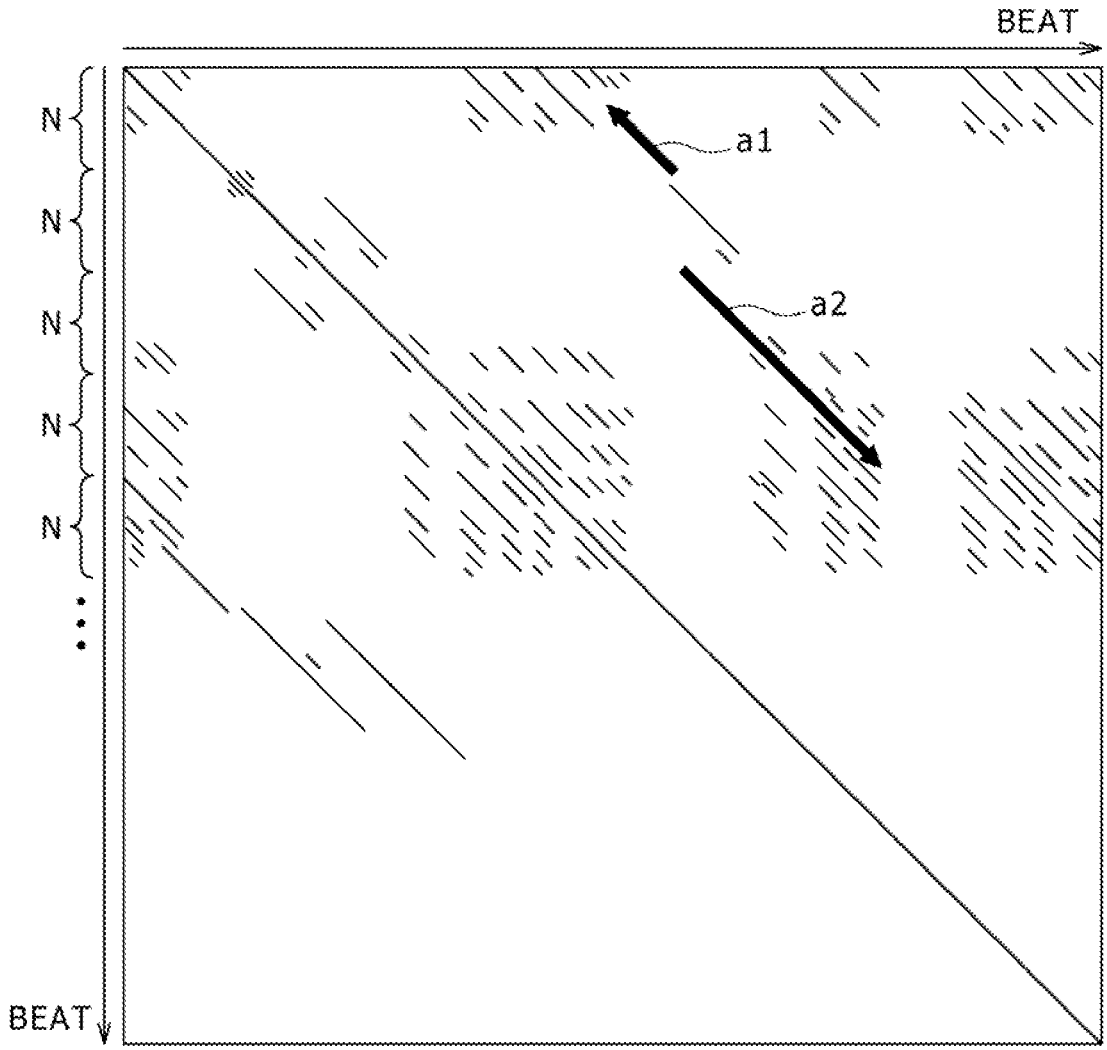
FIG. 24 is a diagram illustrating the exemplary autocorrelation map with intervals of N beats on one side.

FIG. 24 is a diagram illustrating an exemplary autocorrelation map with the intervals of M beats on one side.

The axes of the exemplary autocorrelation map as illustrated in FIG. 24 are the same as those of the exemplary autocorrelation map of FIG. 23. Therefore, an explanation thereof is omitted.

The exemplary autocorrelation map as illustrated in FIG. 24 is a diagram obtained after calculating the correlations with respect to the points corresponding to H beats that precede each of the points indicated by the black dots in the exemplary autocorrelation map of FIG. 23 and, as will be described below, calculating the correlations with respect to the points corresponding to N beats that follow each of the points indicated by the black dots in the exemplary autocorrelation map of FIG. 23, and then indicating the high-correlation areas by the black color and the low-correlation areas by the white color.

Specifically, for example, referring to the exemplary autocorrelation map of FIG. 23, by calculating the correlations with respect to N beats in a direction indicated by arrow a1 shown in FIG. 24 from the points indicated by the black dots and which are on a first Nth beat on the vertical axis, the autocorrelation map generation section 43 generates the autocorrelation map of FIG. 24 in a manner similar to that in which the above-described autocorrelation map of FIG. 15 is generated.

Returning to the flowchart of FIG. 22, at step S34, the autocorrelation map generation section 43 calculates the correlation with respect to the points that follow the points for which the correlation has been generated in the generated autocorrelation map.

Specifically, for example, referring to the exemplary autocorrelation map of FIG. 23, by calculating the correlations with respect to N beats in a direction indicated by arrow a2 shown in the figure from the points indicated by the black dots and which are on a second Nth beat on the vertical axis, the autocorrelation map generation section 43 generates the autocorrelation map of FIG. 24 in a manner similar to that in which the above-described autocorrelation map of FIG. 15 is generated.

That is, as illustrated in FIG. 24, the autocorrelation map generation section 43 calculates the correlations between the beat features at intervals of K beats, and then, continues to calculate the correlations with respect to a maximum of N beats that precede and follow the points for which the calculated correlations are high, only as far as high-correlation points continue, to generate the autocorrelation map.

As described above, the autocorrelation map (i.e., the autocorrelation map of FIG. 23) is first generated with the intervals of the predetermined number of beats on one side (e.g., the vertical axis of FIG. 23), and thereafter, the correlation is calculated with respect to only the several points that precede and follow the high-correlation points to generate the autocorrelation map (i.e., the autocorrelation map of FIG. 24). This method contributes to further reducing a load on the chorus identification process to complete the chorus identification process more quickly.

In the above-described process of step S3, the beat feature removal section 42 may shuffle the beat features supplied from the beat feature extraction section 41 and thereafter remove the phase components from the shuffled beat features.

Figure 25:
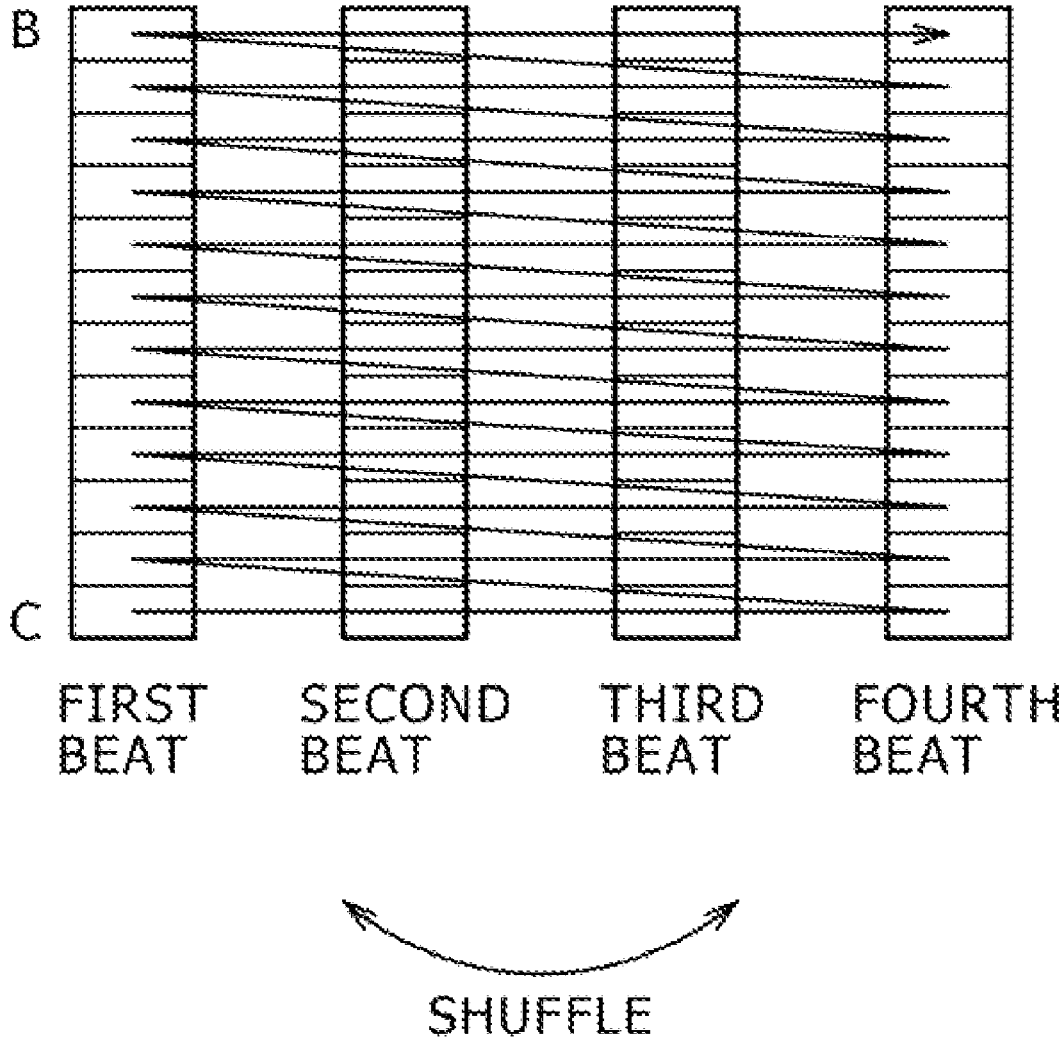
FIG. 25 is a diagram for explaining shuffle of the beat features.

FIG. 25 is a diagram for explaining shuffle of the beat, features.

In an example as illustrated in FIG. 25, four rectangles in the figure represent, as with FIG. 12 and the like, the beat features of the tune waveform separated into the parts each corresponding to each beat. Each of the four rectangles is composed of twelve rectangles representing the chords of the twelve types of tones C, C#, D, D#, E, F, F#, G, G#, A, A#, and B (in the example of FIG. 25, the chord names of only C and B are shown).

Assuming that the four rectangles are referred to as a "first beat", a "second beat", a "third beat", and a "fourth beat" lined from left to right in the figure, the beat feature removal section 42 shuffles the second and third beats and thereafter subjects the shuffled beat features to the discrete Fourier transform or the like to remove the phase components from the extracted beat features, for example.

The shuffle of the beat features as described above contributes to improving the precision of the autocorrelation map (i.e., the process of identifying the tune structure component, such as the chorus).

Note that the above description has been made with reference to an exemplary case where the second and third rectangles in FIG. 25 are shuffled. However, the present invention is not limited to this example. For example, all of the first to fourth rectangles may be shuffled, alternatively.

Further, in order to improve the precision of the autocorrelation map (i.e., the process of identifying the tune structure component, such as the chorus), for example, it may be so arranged that, after the phase components of the beat features are removed by the discrete Fourier transform or the like and the correlations between the beats are calculated, the correlation calculation is performed again while shifting the beat features for one side of the autocorrelation map (e.g., the horizontal or vertical axis in FIG. 15) eleven times.

Figure 26:
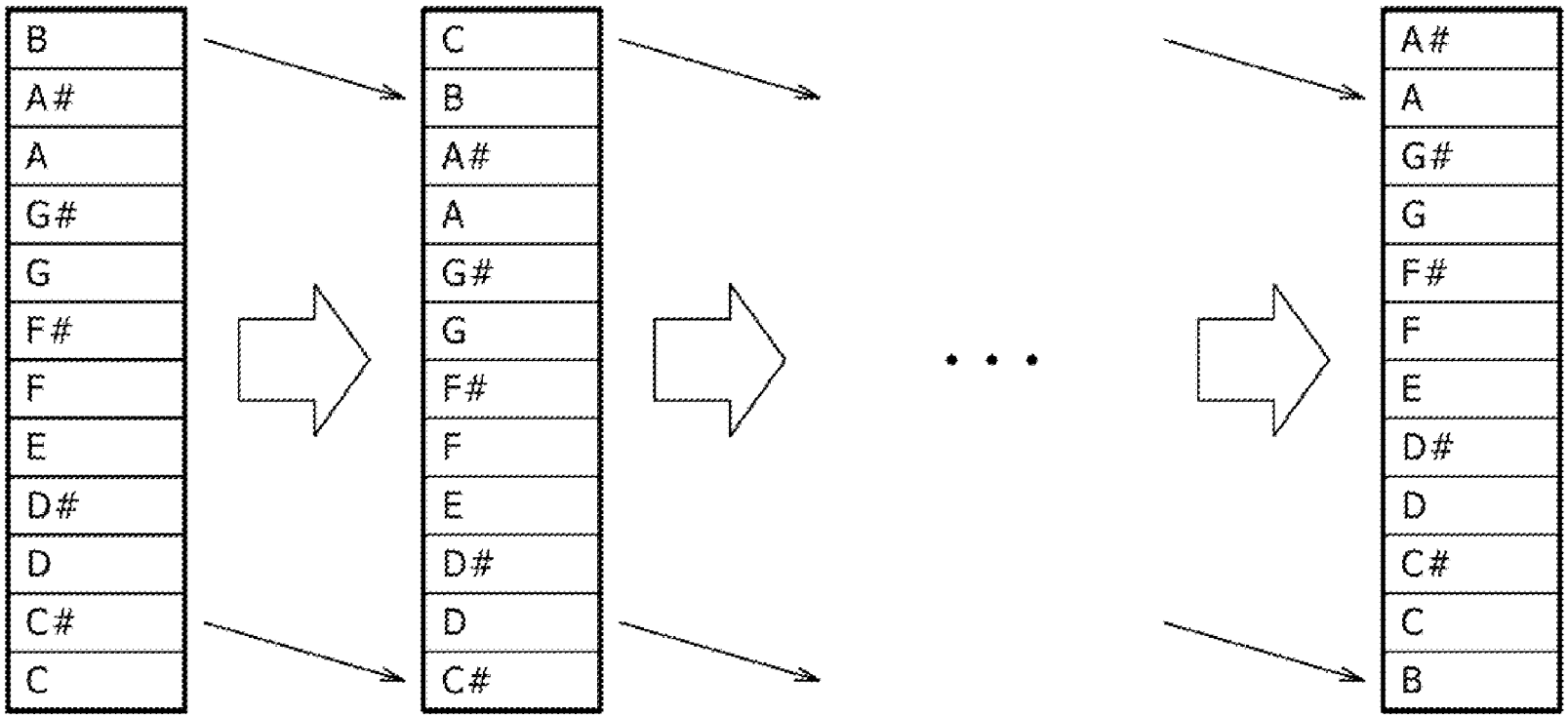
FIG. 26 is a diagram for explaining shift of the beat features.

FIG. 26 is a diagram for explaining the shift of the beat features.

In an example as illustrated in FIG. 26, a first rectangle from the left of the figure (hereinafter referred to as a "first rectangle"; and similarly, subsequent rectangles are referred to as a "second rectangle", a "third, rectangle", . . . , and a "twelfth rectangle", respectively) represents, as with FIG. 12 and the like, the beat feature of the tune waveform separated into the parts each corresponding to each beat, and the rectangle is composed of twelve rectangles contained therein that represent the chords of the twelve types of tones C, C#, D, D#, E, F, F#, G, G#, A, A#, and B.

For example, first, the beat feature removal section 42 subjects the beat feature represented by the first rectangle to the discrete Fourier transform or the like to remove the phase component from the beat feature. The autocorrelation map generation section 43 calculates the correlations between the beat features based on the first rectangle whose phase component has been removed.

Next, the chords of the twelve types of tones in the first rectangle are shifted downward by one, so that the beat feature becomes such that the chords are arranged, as represented, by the second rectangle, from bottom to top in the following order: C#, D, D#, E, F, F#, G, G#, A, A#, B, and C.

At this time, for example, the beat feature removal section 42 subjects the beat feature represented by the second rectangle to the discrete Fourier transform or the like to remove the phase component from the beat feature. The autocorrelation map generation section 43 calculates the correlations between the beat features based on the second rectangle whose phase component has been removed.

Similarly, each of the chords of the twelve types of tones in the beat feature is shifted downward by one sequentially, and, for example, the beat feature removal section 42 subjects the beat features represented by the third to eleventh rectangles (not shown) to the discrete Fourier transform or the like to remove the phase components from the beat features, and the autocorrelation map generation section 43 calculates the correlations between the beat features based on the third to eleventh rectangles whose phase components have been removed.

Finally, the chords of the twelve types of tones in the eleventh rectangle are shifted downward by one, so that the beat feature becomes such that the chords are arranged, as represented by the twelfth rectangle (i.e., the rightmost rectangle in the figure), from bottom, to top in the following order: B, C, C#, D, D#, E, F, F#, G, G#, A, and A#.

At this time, for example, the beat feature removal section 42 subjects the beat feature represented by the twelfth rectangle to the discrete Fourier transform or the like to remove the phase component from the beat feature. The autocorrelation map generation section 43 calculates the correlations between the beat features based on the twelfth rectangle whose phase component has been removed.

Calculating the correlations while shifting the beat feature components eleven times in the above-described manner enables the autocorrelation map generation section 43 to generate a more precise autocorrelation map.

Note that the above description using FIG. 26 has been made with reference to an exemplary case of the shift of the beat feature components of one section (i.e., one beat) in order to facilitate the description. However, also in the case of four sections (i.e., four beats), for example, the precision of the autocorrelation map can be further improved by shifting the beat feature components in a similar manner.

In the present embodiment, in the case where the segmentation process (i.e., the process of step S5 in FIG. 4) is performed, for example, it is desirable to make boundaries between the separated sections coincide with the tops of the measures by improving the precision with which the beats (the tempo, the meter, the tops of the measures, etc.) are detected from the tune waveform (i.e., the audio signal) in the process of detecting the beats (i.e., the process of step S1 in FIG. 4). Thus, the accurate detection of the tops of the measures allows accurate segmentation. Therefore, next, with reference to FIGS. 27 to 40, a process of detecting the tempo, the meter, the tops of the measures (hereinafter referred to as "beat data") from the tune waveform will now be described below.

Figure 27:
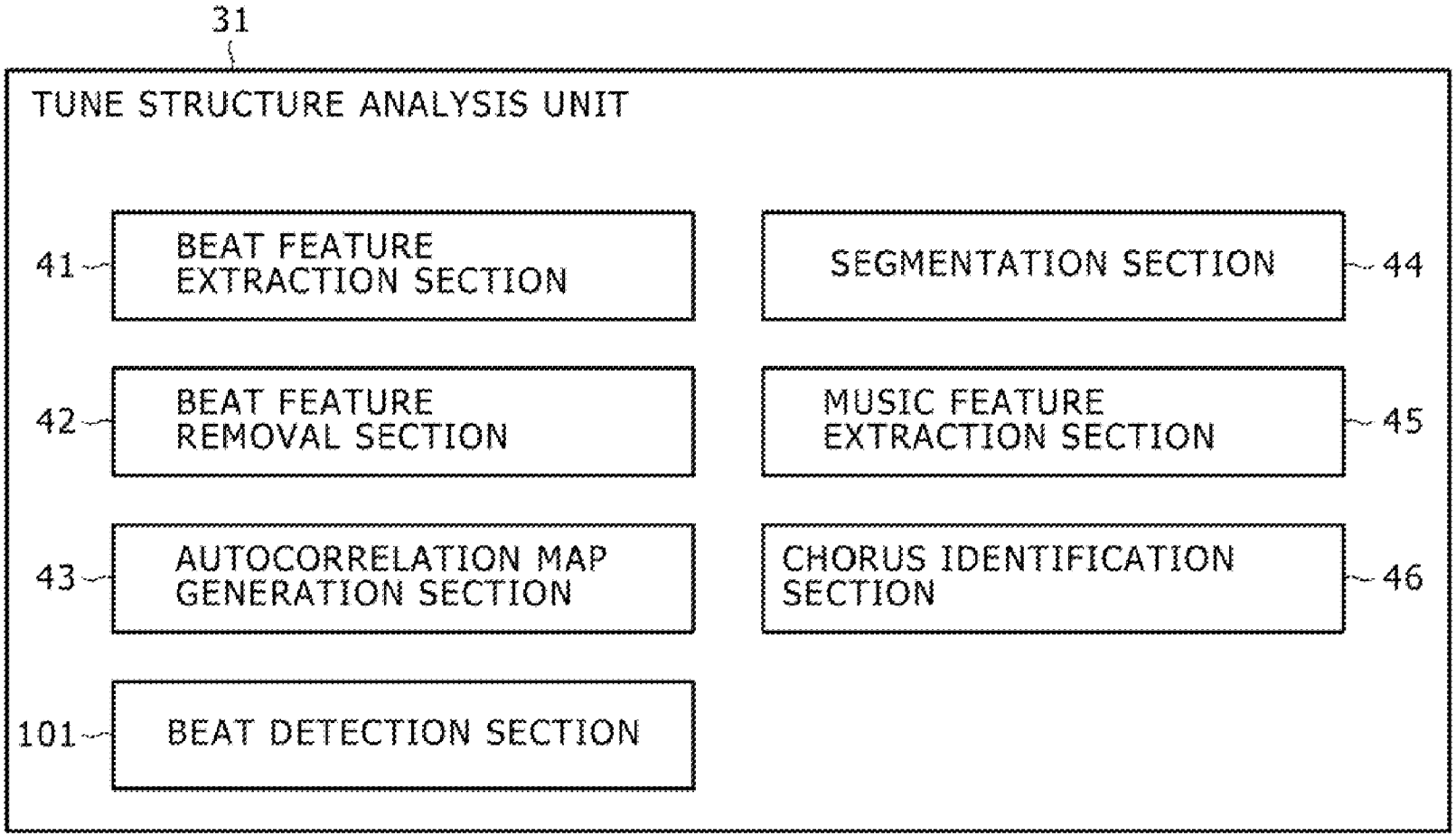
FIG. 27 is a block diagram illustrating another exemplary functional structure of the software executed by the CPU of the personal computer.

FIG. 27 is a block diagram illustrating another exemplary functional structure of the software executed by the CPU 11 of the personal computer 1 of FIG. 2.

In FIG. 27, the same elements as those in FIG. 3 are denoted by the same reference numerals, and descriptions of processes of the elements that perform, the same processes as those in FIG. 3 are omitted to avoid redundancy. That is, as compared to the tune structure analysis unit 31 of FIG. 3, the tune structure analysis unit 31 of FIG. 27 is additionally provided with a beat detection unit 101.

The beat detection unit 101 detects the beat data from the tune waveform. For example, the beat detection unit 101 detects the beat data, such as the tempo, the meter, or the tops of the measures, from the tune waveform reproduced from the audio signal obtained by the audio compression according to the MP3 system, the AAC system, or the like.

Figure 28:
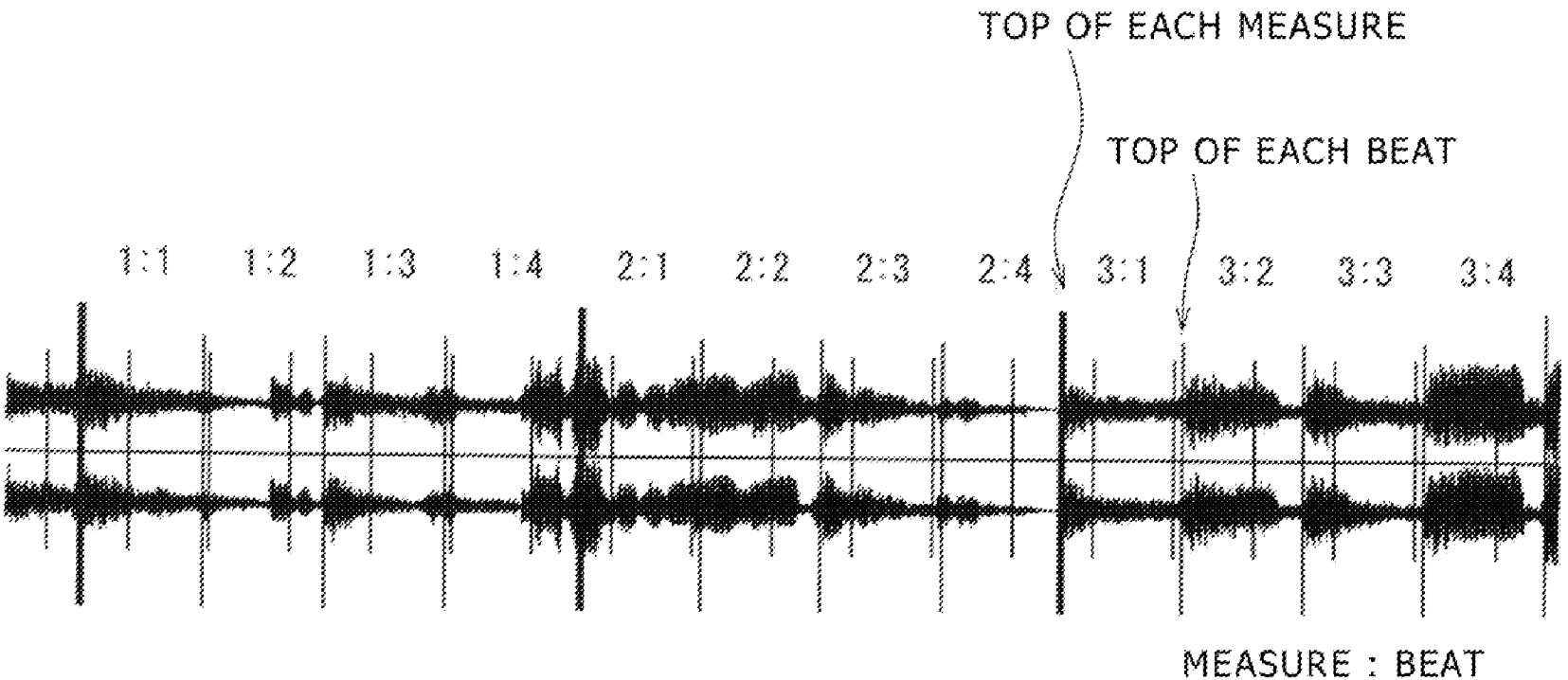
FIG. 28 is a diagram illustrating an example of the beats detected from the tune waveform.

Next, referring to FIG. 28, the beat detection unit 101 that detects the position of each beat from the tune waveform will now be described below. In FIG. 28, vertical lines corresponding to numbers "1:1, 1:2, 1:3, 1:4, 2:1, 2:2, 2:3, 2:4, 3:1, 3:2, 3:3, 3:4, and so on" (these numbers, such as "1:1", express "measure:beat" as shown at the lower left-hand of the figure) indicate the positions of the tops of the beats in the tune waveform. In FIG. 28, a range between the position indicated by any of the vertical, lines corresponding to the respective numbers and the position indicated by the next vertical line represents a range of the beat in the tune waveform.

A width of an interspace between two adjacent vertical lines represents, for example, the duration of the quarter note, and corresponds to the tempo. The positions indicated by the vertical lines corresponding to the numbers "1:1", "2:1", "3:1", and so on indicate the tops of the measures.

In other words, the beat detection unit 101 detects, as the beat data, the top of each beat or the top of each measure indicated by the vertical lines in the figure or the tempo (i.e., the width of the interspace between two adjacent vertical lines in the figure) from the tune waveform resultant from the audio signal as illustrated in FIG. 28.

Figure 29:
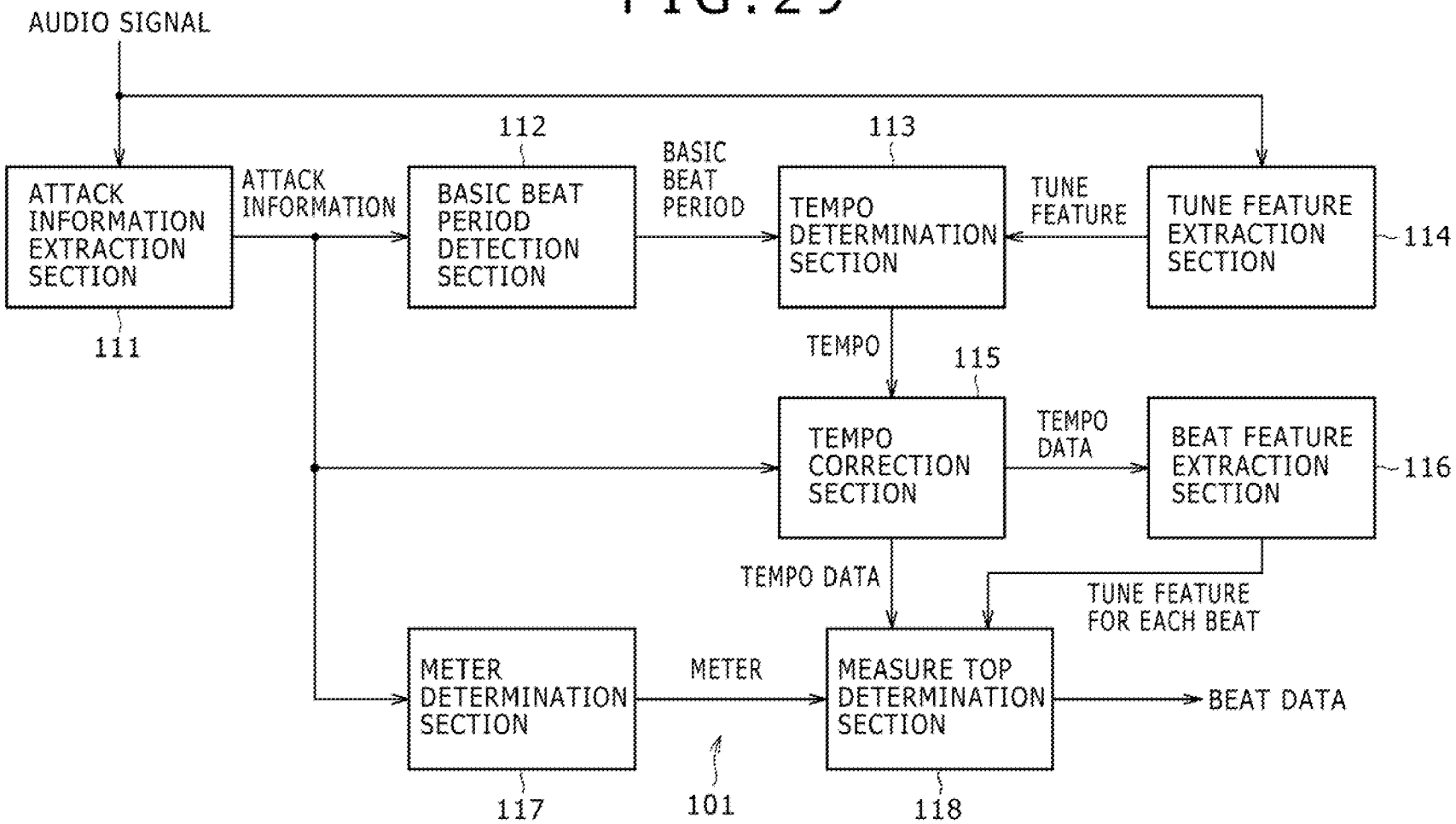
FIG. 29 is a block diagram illustrating an exemplary structure of a beat detection unit.

FIG. 29 is a block diagram illustrating an exemplary structure of the beat detection unit 101. The beat detection unit 101 includes an attack information extraction, section 111, a basic beat period detection section 112, a tempo determination section 113, a tune feature extraction section 114, a tempo correction section 115, a beat feature extraction section 116, a meter determination section 117, and a measure top determination section 118.

Figure 30:
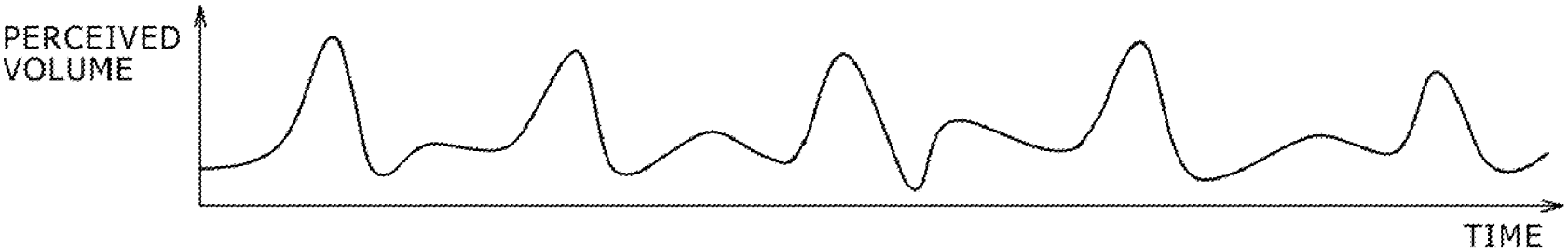
FIG. 30 is a diagram for explaining extraction of attack information.

The attack information extraction section 111 extracts time-series attack information from the audio signal representing the tune waveform. Here, the time-series attack information is data representing a change in volume over time, which allows humans to perceive beats. As illustrated in FIG. 30, the attack information is represented by perceived volume, i.e., the volume perceived by the humans over time.

For example, the attack information extraction section 111 extracts, from the audio signal, the attack information that represents a level of sound at each point in time, the sound being based on the audio signal.

Figure 31:
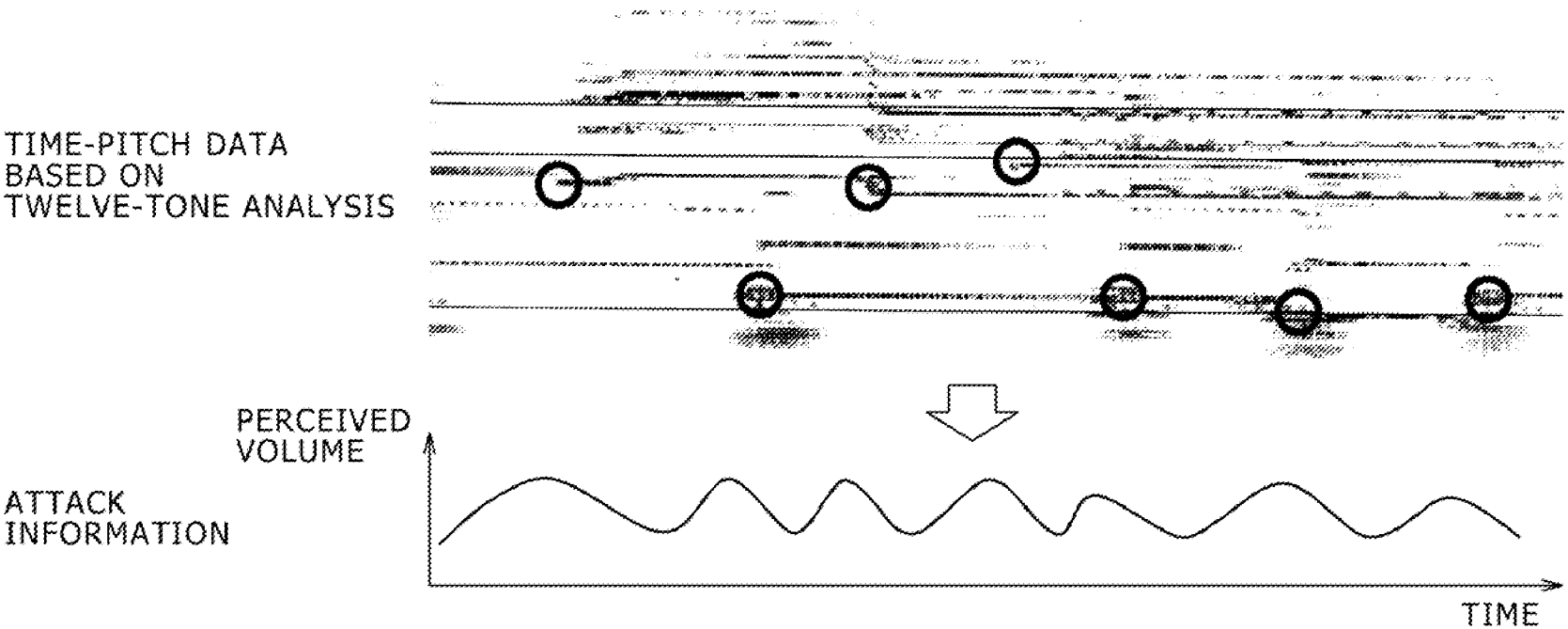
FIG. 31 is a diagram for explaining the extraction of attack information.

Alternatively, for example, as illustrated in FIG. 31, the attack information extraction section 111 divides the sound based on the audio signal into a plurality of octave components, and determines energies of twelve tones in each octave that have respective pitches according to the twelve-tone equal temperament to obtain time-pitch data based on twelve-tone analysis. The time-pitch data represents the energy of each of the twelve tones in each octave. The attack information extraction section 111 adds up, with respect to each point in time, the energies of sounds concerning the twelve tones and the plurality of octaves, and regards the result of the addition as the attack information.

Alternatively, for example, the attack information extraction section 111 divides the sound based on the audio signal into a plurality of octave components, and detects timing at which each of the twelve tones in each octave that have the respective pitches according to the twelve-tone equal temperament begins to sound. For example, in the case where a difference in the energy of each tone over time is larger than a predetermined threshold, the attack information extraction section 111 regards that moment as a time point at which that tone begins to sound.

Then, regarding a time point at which each tone begins to sound as "1" and the other time points as "0", the attack information extraction section 111 adds up such values with respect to each of the twelve tones in each octave, and regards the result of the addition as the attack information.

In FIG. 31, circles indicate positions at which tones begin to sound. In the case where the time points at which tones begin to sound are regarded as "1" and the other time points as "0", and these values are added up to obtain the attack information, in the attack information, a time point at which many of the twelve tones in the plurality of octaves begin to sound has a large value, while a time point at which less of the twelve tones in the plurality of octaves begin to sound has a smaller value.

Further, for example, the attack information extraction section 111 divides the sound based on the audio signal into a plurality of octave components, and determines a change in energy of each of the twelve tones in each octave that have the respective pitches according to the twelve-tone equal temperament. The change in energy of each tone is calculated, for example, in terms of a difference in energy of the tone over time. The attack information extraction section 111 adds up the changes in energy of the twelve tones in each of the octaves with respect to each point in time, and regards the result of the addition as the attack information.

Returning to FIG. 29, the attack information extraction section 111 supplies the attack information to the basic beat period detection section 112, and the tempo correction section 115, and the meter determination section 117.

The basic beat period detection section 112 detects the duration of the most basic sound in the tune with respect to which the chords are to be detected. The most basic sound in the tune is, for example, a sound represented by a quarter note, an eighth note, or a sixteenth note.

Hereinafter, the duration of the most basic sound in the tune will be referred to as a "basic beat period".

The basic beat period detection section 112 determines the basic beat period by performing basic pitch detection while regarding the attack information, which is time-series information, as an ordinary waveform.

Figure 32:
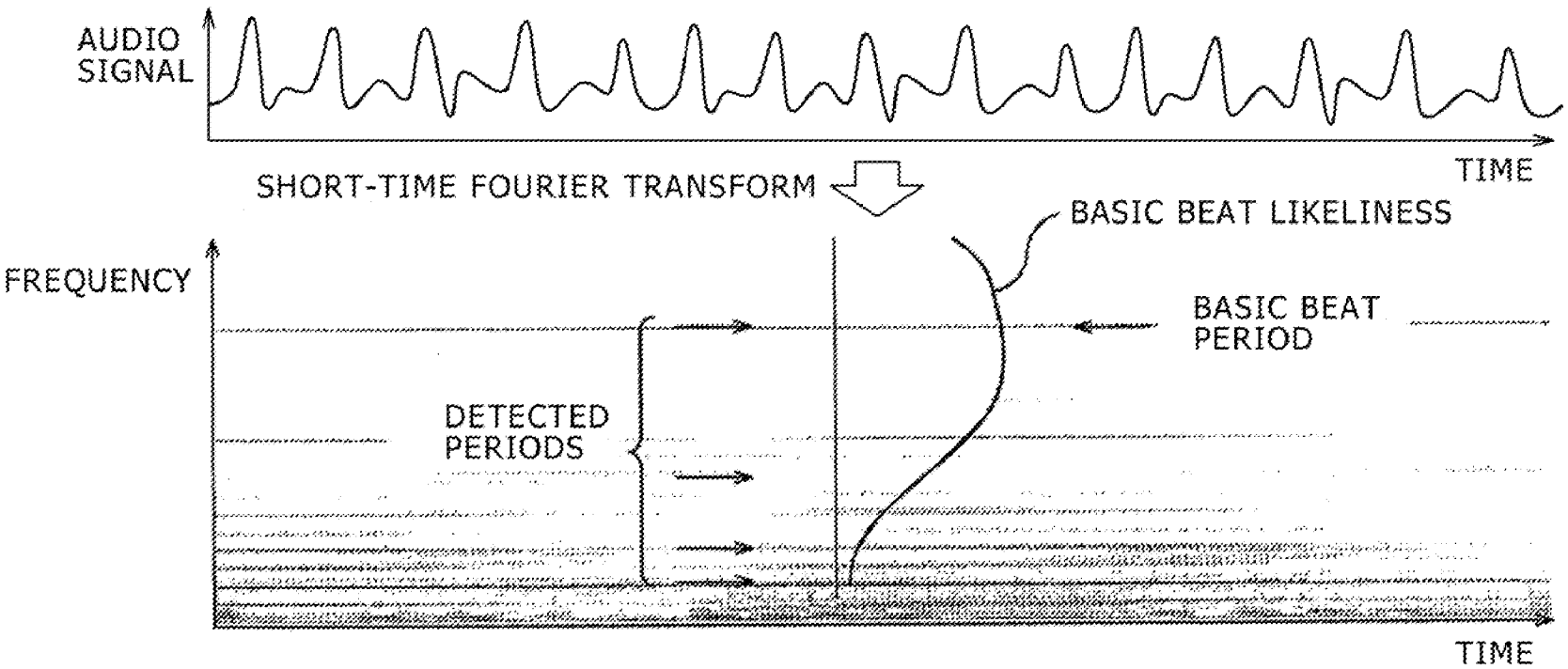
FIG. 32 is a diagram for explaining detection of a basic beat period.

For example, as illustrated in FIG. 32, the basic beat period detection section 112 subjects the attack information, which is time-series information, to a short-time Fourier transform (STFT). Subjecting the attack information to the short-time Fourier transform results in time-series data representing the intensity of energy in different frequencies.

Specifically, while sliding the position of a window that is sufficiently short in period as compared to the temporal length of the attack information little by little in relation to the attack information, the basic beat period detection section 112 subjects a part of the attack information within the window to the Fourier transform, and arranges results of the Fourier transform in chronological order, whereby the time-series data representing the intensity of the energy in each frequency over time is obtained.

As a result of the short-time Fourier transform, a frequency with intense energy as compared to the energy of the other frequencies is detected as a period that is a candidate for the basic beat period. In the lower part of FIG. 32, depth indicates the intensity of the energy.

The basic beat period detection section 112 regards the most predominant one of the periods detected as a result of the short-time Fourier transform of the attack information as the basic beat period.

Specifically, while comparing basic beat likeliness, which is a previously prepared weight, with the result of the short-time Fourier transform of the attack information, the basic beat period detection section 112 determines, from among the periods detected as a result of the short-time Fourier transform of the attack information, one of the periods with high basic beat likeliness to be the basic beat period.

More specifically, using the basic beat likeliness that is a previously prepared weight extending in frequency direction, the basic beat period detection section 112 weights the energy of each of the frequencies obtained as a result of the short-time Fourier transform of the attack information, and determines the period with the highest, of values obtained as a result of the weighting to be the basic beat period.

Use of the basic beat likeliness that is the weight extending in frequency direction prevents periods of extremely low frequencies or periods of extremely high frequencies, i.e., periods that can never become the basic beat period, from being determined to be the basic beat period.

Returning to FIG. 29, the basic beat period detection section 112 supplies the thus extracted basic beat period to the tempo determination section 113.

By applying a predetermined signal processing to the audio signal, the tune feature extraction section 114 extracts a predetermined number of features (hereinafter referred to as "tune features") from the tune. For example, the tune feature extraction section 114 divides the audio signal into a plurality of octave components, then obtains signals of the twelve tones in each octave that, have the respective pitches according to the twelve-tone equal temperament, and then applies a predetermined signal processing to the signals of the twelve tones in each octave to extract the tune feature.

For example, the tune feature extraction section 114 obtains, as the time feature, the number of peaks in unit time of the signals of the twelve tones in each octave.

Further, for example, the tune feature extraction section 114 obtains, as the tune feature, energy dispersal in pitch direction of the signals of the twelve tones in each octave.

Still further, for example, the tune feature extraction section 114 obtains, as the tune feature, balance between low-range, medium-range, and high-range energies from the signals of the twelve tones in each octave.

Still further, for example, the tune feature extraction section 114 obtains, as the tune feature, the degree of correlation between signals of left and right, channels of a stereo audio signal from the signals of the twelve tones in each octave.

The tune feature extraction section 114 supplies the thus extracted, tune feature to the tempo determination section 113.

The tempo determination section 113, which is previously constructed by learning using the tune feature and the tempo, estimates the tempo based, on the tune feature supplied from the tune feature extraction section 114. Hereinafter, the tempo estimated will be referred to as an estimated tempo.

Based on the estimated tempo and the basic beat period supplied from the basic beat period detection section 112, the tempo determination section 113 determines the basic beat period multiplied by Xth power of 2 (e.g., ⅓, ¼, ½, 1, 2, 4, 8, etc.) to be the tempo. With the estimated tempo obtained by regression analysis of the feature of the tune, a value obtained by multiplying the basic beat period by 2 or ½ and which falls within a range between the estimated tempo$\times 2^{1/2}$ and the estimated tempo$\div 2^{1/2}$ is determined to be the tempo, for example.

Figure 33:
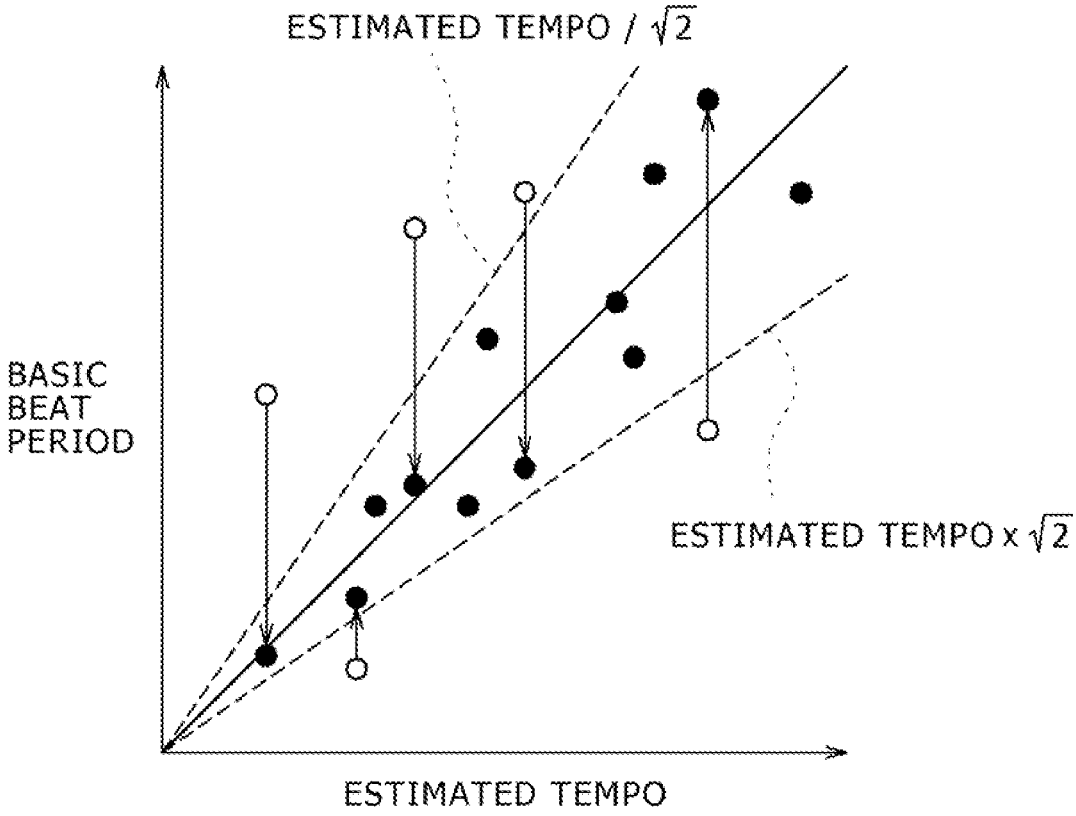
FIG. 33 is a diagram for explaining determination of a tempo.

For example, as illustrated in FIG. 33, in the case where the basic beat period (i.e., the basic beat periods represented by white circles in an upper part of FIG. 33) supplied from the basic beat period detection section 112 is longer than a period obtained by dividing the estimated tempo by $2^{1/2}$, the tempo determination section 113 multiplies the basic beat period by ½.

In the case where the basic beat period (i.e., the basic beat periods represented by white circles in an lower part of FIG. 33) supplied from the basic beat period detection section 112 is shorter than a period obtained by multiplying the estimated tempo by $2^{1/2}$, the tempo determination section 113 multiplies the basic beat period by 2.

The tempo determination section 113 determines the basic beat period, (i.e., the basic beat periods represented by black circles in FIG. 33) multiplied by ½ or 2 or multiplied by ½ or 2 repeatedly so as to fall within the range between the estimated tempo$\times 2^{1/2}$ and the estimated tempo$\div 2^{1/2}$ to be the tempo.

Note that in the case where the basic beat period falls within the range between the estimated tempo$\times 2^{1/2}$ and the estimated tempo$\div 2^{1/2}$, the tempo determination section 113 determines the basic beat period as it is to be the tempo.

Returning to FIG. 29, the tempo determination section 113 supplies the thus determined tempo to the tempo correction section 115.

Based on the attack information supplied from the attack information extraction section 111, the tempo correction section 115 makes minute correction to the tempo determined in the tempo determination section 113.

First, the tempo correction section 115 corrects a phase of the beats.

Figure 34:
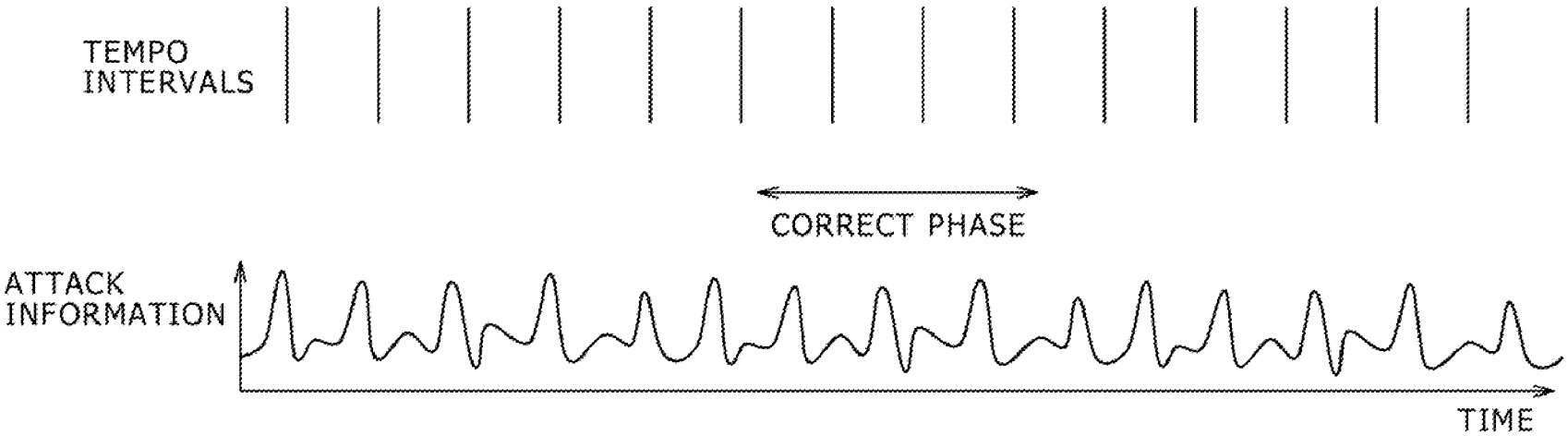
FIG. 34 is a diagram for explaining correction of the tempo.

Specifically, as illustrated in FIG. 34, the tempo correction section 115 adds up attack information components, each from each beat range, at intervals of the tempo determined with respect to the attack information throughout the entire tune.

For example, the tempo correction section 115 adds up a first attack information sample of each of the first to last, beat ranges throughout the entire tune, with each of the beat ranges being determined based on the interval of the tempo, and then the tempo correction section 115 regards a result of the addition as a sum total of a first section in the beat range. Next, the tempo correction section 115 adds up a second attack information sample of each of the first to last beat, ranges throughout the entire tune, with each, of the beat ranges being determined based on the interval of the tempo, and then the tempo correction section 115 regards a result of the addition as a sum total of a second section of the beat range.

Similarly, the tempo correction section 115 adds up a third to last attack information sample of each of the first to last beat ranges throughout the entire tune in regular sequence, with each of the beat ranges being determined based on the interval of the tempo, and then the tempo correction section 115 regards results of the addition as sum totals of third to last sections in the beat range, respectively.

Then, shifting the phase of the tempo intervals sideways with respect to the attack information, the tempo correction section 115 similarly adds up the attack information components, each from each beat range, throughout the entire tune.

The tempo correction section 115 corrects the phase of the tempo intervals with respect to the attack information to a phase for which the sum total has the largest value of all sum totals obtained by shifting the phase of the tempo intervals sideways with respect to the attack information. That is, the tempo correction section 115 corrects the positions of the beats so as to correspond to the positions of the tempo intervals with respect to the attack information for which the largest sum total has been obtained.

In addition, the tempo correction section 115 corrects the tempo.

Figure 35:
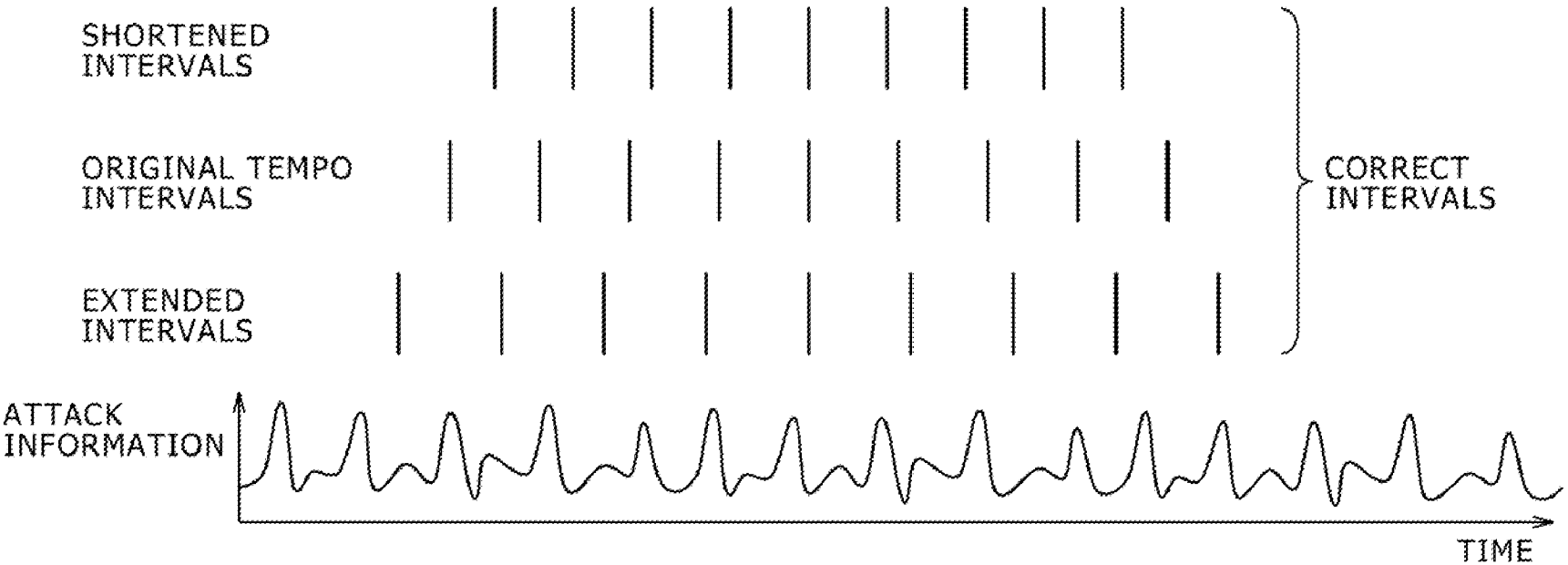
FIG. 35 is a diagram for explaining the correction of the tempo.

Specifically, as illustrated in FIG. 35, the tempo correction section 115 shortens or extends the tempo intervals by a predetermined length that is sufficiently short as compared to that of the intervals, and, with the shortened or extended tempo intervals, the tempo correction section 115 adds up the attack information components at intervals of the tempo throughout the entire tune.

In this case also, the tempo correction section 115 acids up the first to last attack information samples of each of the first to last beat ranges throughout the entire tune in sequential order, with each of the beat ranges being determined based on the interval of the tempo, and then the tempo correction section 115 regards results of the addition as sum totals of the first to last sections in the beat range, respectively.

The tempo correction section 115 shortens or extends the tempo intervals by the predetermined length, and adds up the attack information components at intervals of the shortened or extended tempo throughout the entire tune to obtain the sum totals of the first to last sections in the beat range.

The tempo correction section 115 corrects the tempo intervals so as to have a length of one of the original, shortened, and extended tempo intervals for which the largest sum total has been obtained.

The tempo correction section 115 repeats the above-described correction of the beat phase and the above-described correction of the tempo as necessary to determine the final tempo. For example, the tempo correction section 115 repeats the correction of the beat phase and the correction of the tempo a predetermined number of times, e.g., twice for both, to determine the final tempo.

Returning to FIG. 29, the tempo correction section 115 supplies tempo data representing the finally determined tempo to the beat feature extraction section 116 and the measure top determination section 118.

Based on the tempo data supplied from the tempo correction section 115, the beat feature extraction section 116 extracts the tune feature, such as the music feature or the chord, from each segment (i.e., each beat).

Figure 36:
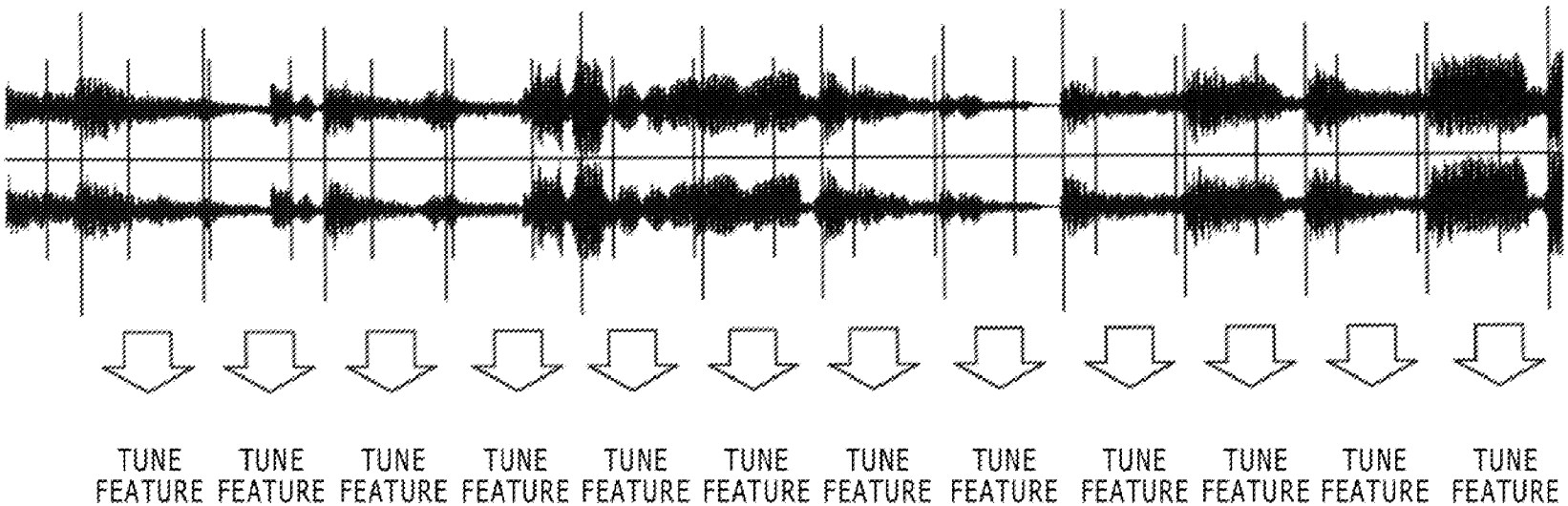
FIG. 36 is a diagram for explaining extraction of a tune feature.

For example, from the tune waveform as illustrated in FIG. 36, the beat feature extraction section 116 extracts the tune feature from each beat, as separated by the vertical lines in the figure (in an example as illustrated in FIG. 36, the tune waveform is separated into twelve sections).

Note that the tune feature extracted by the beat feature extraction section 116 is, as with the above-described tune feature extracted by the tune feature extraction section 114, extracted by applying a predetermined signal processing to a signal obtained as a result of the twelve-tone analysis, for example.

Returning to FIG. 29, the beat feature extraction section 116 supplies the tune feature extracted from each beat to the measure top determination section 118.

Based on the attack information supplied from the attack, information extraction section 111, the meter determination section 117 determines the meter, such as 4/4 meter, 3/4 meter, 6/8 raster, for example.

Here, as to a method for determining the meter, a harmonic structure of the attack information subjected to the short-time Fourier transform can be used to determine the meter, for example. For example, referring to FIG. 37, as the basic beat period detection section 112 has done, the meter determination section 117 subjects the attack information, which is time-series information, to the short-time Fourier transform. As a result, time-series data representing the intensity of the energy in different frequencies is obtained.

Figure 37:
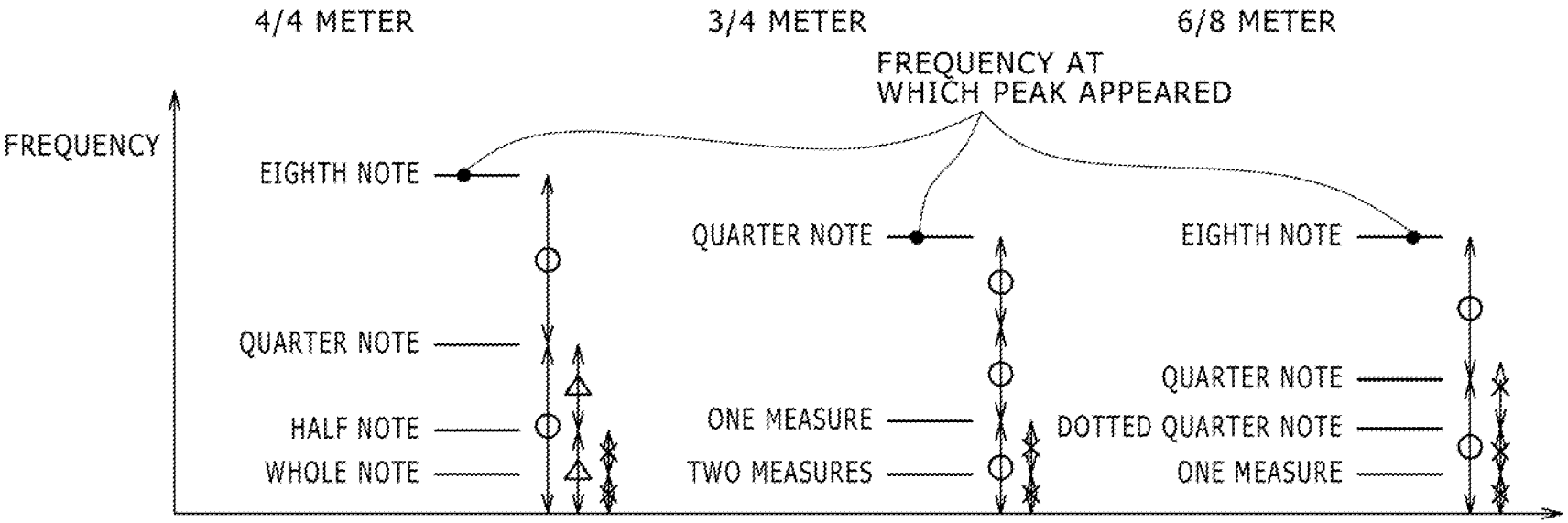
FIG. 37 is a diagram for explaining determination of a meter.

That is, as illustrated in an example of FIG. 37, since the result obtained by subjecting the attack information to the short-time Fourier transform allows detection of a frequency at which a peak has appeared, that frequency is used to determine the meter. For example, in the 4/4 meter illustrated on the left-hand side of the figure, the relationships between the eighth note, the quarter note, the half note, and the whole note are as follows: the frequency of the quarter note is half the frequency of the eighth note as indicated by circles in the figure; the frequency of the half note is half the frequency of the quarter note as indicated by triangles in the figure; and the frequency of the whole note is half the frequency of the half note as indicated by crosses in the figure. In other words, the period of the quarter note is twice the period of the eighth note, the period of the half note is twice the period of the quarter note, and the period of the whole note is twice the period of the half note.

Further, similarly, for example, in the 3/4 meter illustrated in the middle of the figure, the relationships between the quarter note, one measure, and two measures are as follows: the frequency of one measure is one-third the frequency of the quarter note as indicated by circles in the figure; and the frequency of two measures is half the frequency of one measure as indicated by crosses in the figure.

Still further, similarly, in the 6/8 meter illustrated on the right-hand side of the figure, the relationships between the eighth note, the quarter note, a dotted quarter note, and one measure are as follows: the frequency of the quarter note is half the frequency of the eighth note as indicated by circles in the figure; and as indicated by crosses in the figure, the frequency of the dotted quarter note is two-thirds the frequency of the quarter note, and the frequency of one measure is one-third the frequency of the quarter note.

That is, the meter determination section 117 determines the meter based on a pattern of energy interval at the frequency at which the peak has appeared, i.e., the harmonic structure of the attack information subjected to the short-time Fourier transform.

Figure 38:
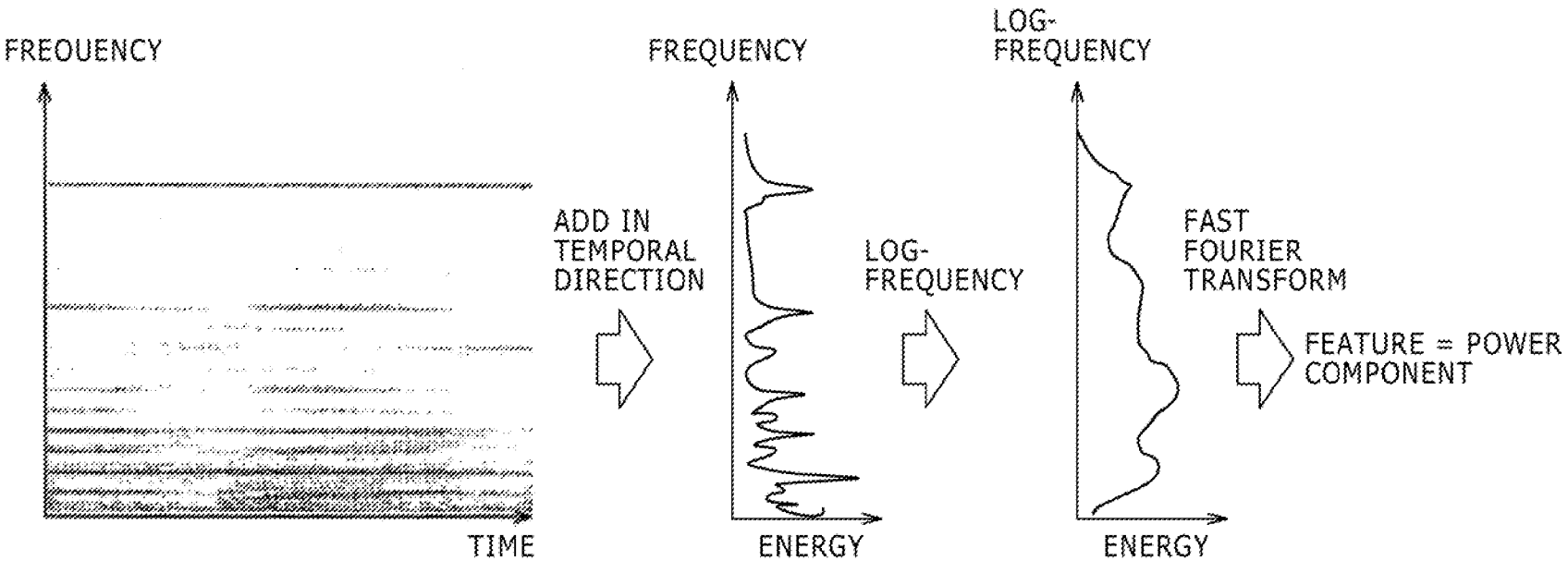
FIG. 38 is a diagram for explaining the determination of the meter.

FIG. 38 is a diagram for explaining a specific example of a method for determining the meter performed by the meter determination section 117.

FIG. 38 shows three graphs: a graph where a horizontal axis represents time and a vertical axis represents frequency (hereinafter referred to as a "time versus frequency graph") as shown on the left-hand side of the figure; a graph where a horizontal axis represents energy and a vertical axis represents frequency (hereinafter referred to as an "energy versus frequency graph") as shown to the right of the time versus frequency graph; and a graph where a horizontal axis represents energy and a vertical axis represents log-frequency (hereinafter referred to as an "energy versus log-frequency graph") as shown to the right of the energy versus frequency graph.

Referring to FIG. 38, first, the meter determination section 117 adds up, in temporal direction, frequencies in the time versus frequency graph obtained by subjecting the attack information to the short-time Fourier transform to obtain the energy versus frequency graph. Next, the meter determination section 117 converts the frequency axis in the energy versus frequency graph into a log-frequency axis to obtain the energy versus log-frequency graph.

Then, the meter determination section 117 compares a feature that is a power component obtained by subjecting an energy for each log-frequency indicated in the energy versus log-frequency graph to a fast Fourier transform (FFT) with a previously prepared meter pattern to determine the meter.

Returning to FIG. 29, the meter determination section 117 supplies the thus determined meter to the measure top determination section 118.

The measure top determination section 118 receives the tempo data from the tempo correction section 115, the tune feature for each beat from the beat feature extraction section 116, and the meter from the meter determination section 117. Based on the tempo data, the feature for each beat, and the meter, the measure top determination section 118 determines the tops of the measures.

Here, regarding a method for determining the tops of the measures, the tops of the measures have, for example, the following characteristics as compared to the other parts of the measures: the chord is more likely to change; a musically stable chord (e.g., a so-called three chord) appears with a high probability; the pitch is distinct and stable; and there is an accent in terms of volume.

Using these characteristics of the tops of the measures, the measure top determination section 118 estimates a measure top likeliness of each beat. Note that the measure top determination section 118 is, for example, previously constructed by learning using the chord and the feature of each beat, or the like, and estimates the measure top likeliness based on the tempo data, the tune feature for each beat, and the meter.

Figure 39:
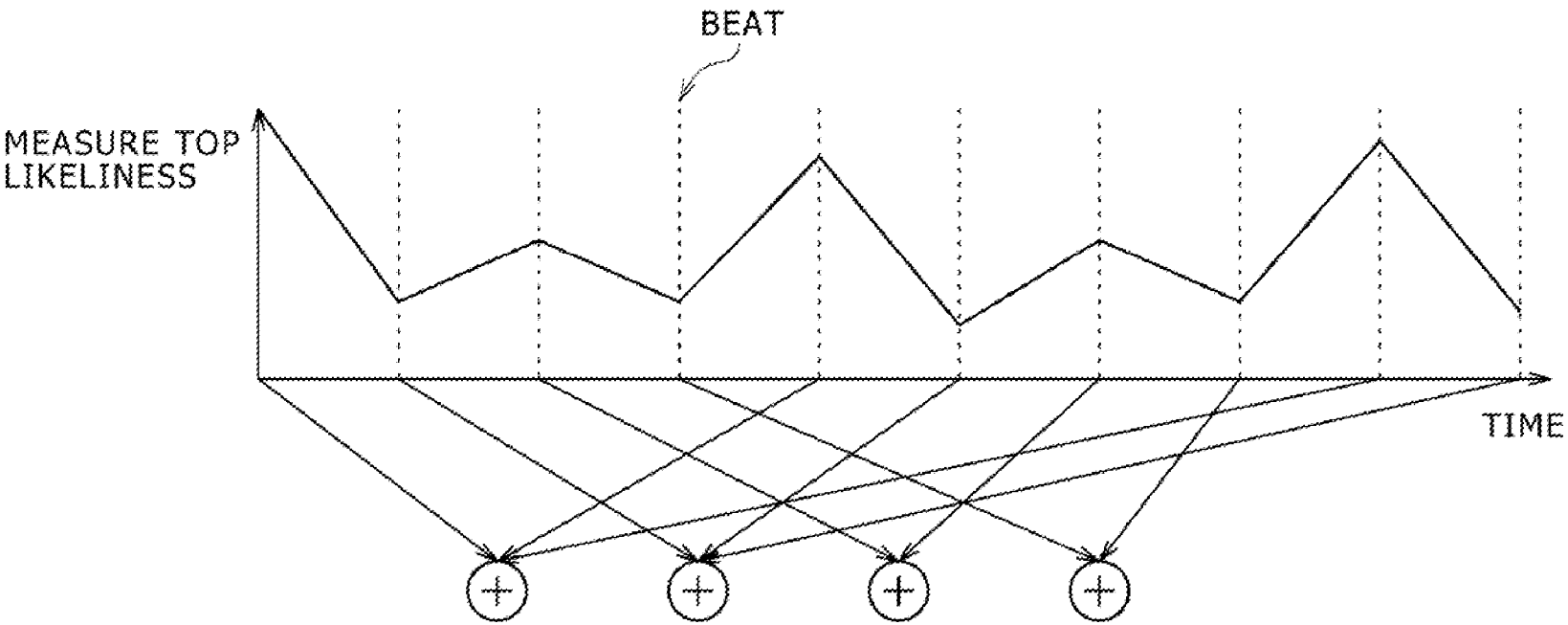
FIG. 39 is a diagram for explaining determination of tops of measures.

Next, as illustrated in an example of FIG. 39, the measure top determination section 118 adds up the estimated measure top likeliness of every number of codes in one measure of meter throughout the entire tune or through a specific range (for example, four in the 4/4 meter, three in the 3/4 meter, six in the 6/8 meter, etc.). That is, in the case of the example of FIG. 39, where the meter is 4/4, the measure top likeliness of every fourth beat is added up. More specifically, the measure top likelinesses of a first beat, a fifth beat, a ninth beat, etc. (hereinafter referred to as "1/4-th beats") are added up; the measure fop likelinesses of a second beat, a sixth beat, a tenth beat, etc, (hereinafter referred to as "2/4-th beats") are added up; the measure top likelinesses of a third beat, a seventh beat, an eleventh beat, etc. (hereinafter referred to as "3/4-th beats") are added up; and the measure top likelinesses of a fourth beat, an eighth beat, a twelfth beat, etc. (hereinafter referred to as "4/4-th beats") are added up.

Figure 40:
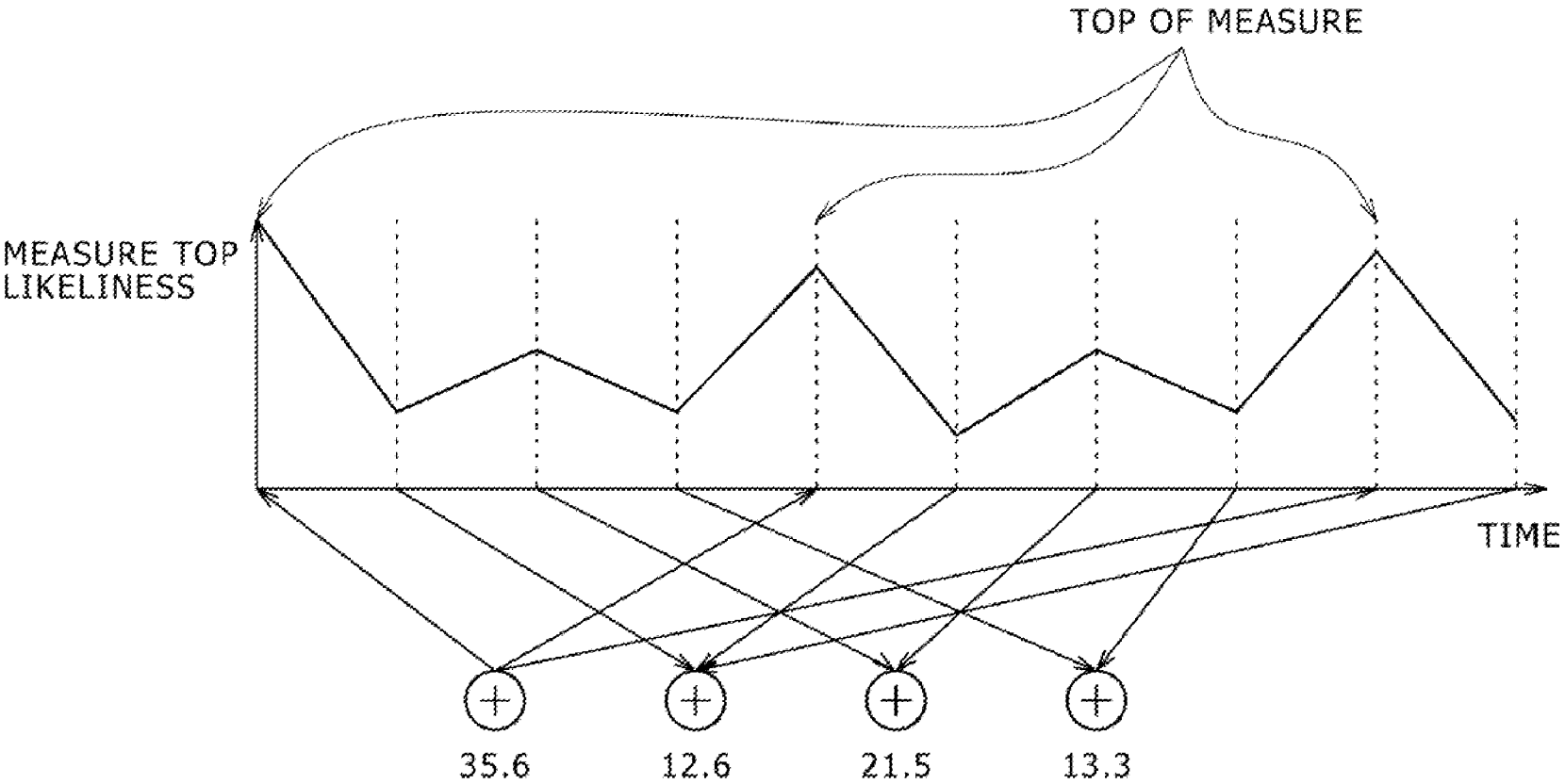
FIG. 40 is a diagram for explaining the determination of the tops of the measures.

Then, as illustrated in the example of FIG. 40, where the meter is 4/4, the measure top determination section 118 compares the sum totals of the measure top likelinesses of every fourth, beat with one another, and determines the beats with the highest measure top likeliness to be the tops of the measures. More specifically, in the case of the example of FIG. 40, the sum total of the values of the measure top likeliness of the 1/4-th beats is 35.6, the sum total of the values of the measure top likeliness of the 2/4-th beats is 12.6, the sum total of the values of the measure top likeliness of the 3/4-th beats is 21.5, and the sum total of the values of the measure top likeliness of the 4/4-th beats is 13.3. That is, the sum total of the values of the top likeliness of the 1/4th beats is the highest of all. Therefore, the measure top determination section 116 determines the 1/4-th beats to be at the tops of the measures.

As described above, the beat detection unit 101 detects the beat data, such as the tempo, the meter, and the tops of the measures, from the tune waveform (i.e., the audio signal), and outputs the beat data. That is, since the beat detection unit 101 is able to obtain the beat data by the above-described method in the process of detecting the beats (i.e., the process of step S1 in FIG. 4), for example, the beat detection unit 101 is able to detect the beats more precisely. As a result, accurate segmentation becomes possible in the segmentation process (i.e., the process of step S5 in FIG. 4), for example, which in turn allows more precise identification of the chourusesection in the chorus identification process (i.e., the process of step S7 in FIG. 4).

Here, operation amounts (i.e., the number of multiplications and additions) when the analysis of the waveform of a tune involving a modulation is performed by a related art technique and the technique of the present invention will now be compared with each other. In order to equalize conditions when comparing them, the operation amounts thereof are compared assuming, for example, that the length of the tune is five minutes, that the tempo is 120, and that the number of beats used for the correlation calculation is eight beats.

First, in the case where the analysis of the waveform of the tune involving the modulation is performed by the related art technique, an operation amount a1 when calculating the average and norm for calculating the correlations is as follows:

Operation amount $a1$=(the number of beats)×(8 beats)×(12 tones)×(2(the average and the norm))= 5×120×8×12×2=115,200(the number of operations)

Further, an operation amount a2 when calculating the correlations is as follows:

Operation amount $a2$=(the number of beats)×(the number of beats/2+1)×(8 beats)×(12 tones)×(12 shifts)−5×120×299×8×12×12=206,668,800(the number of operations)

Accordingly, an operation amount A in the case of the related art technique is as follows:

Operation amount $A$=operation amount $a1$+operation amount $a2$=115,200+206,668,800=206,784,000 (the number of operations)

Next, in the case where the analysis of the waveform of the tune involving the modulation is perform by the technique of the present invention, an operation amount b1 when removing the phase component by the discrete Fourier transform and calculating the average and norm for calculating the correlations is as follows:

Operation amount $b1$=(the number of beats)×((8 beats)×(12 tones))$^2$(the calculation of the discrete Fourier transform)+(the number of beats)×(the features after the discrete Fourier transform)×(2 (the average and the norm))=5×120×(8×12)$^2$+5×120×47×2=5,529,600+56,400=5,586,000 (the number of operations)

Further, an operation amount b2 when calculating the correlations is as follows:

Operation amount $b2$=(the number of beats)×(the number of beats/2+1)×(the features after the discrete Fourier transform)=5×120×299×47=8,431,300(the number of operations)

Accordingly, an operation amount E in the case of the technique of the present invention is as follows:

Operation amount $B$=operation amount $b1$+operation amount $b2$=5,586,000+8,431,800=14,017,800 (the number of operations)

As described above, the operation amount A in the case of the related art technique and the operation amount B in the case of the technique of the present invention are 206,784,000 (the number of operations) and 14,017,800 (the number of operations), respectively. That is, the operation amount B in the case of the technique of the present invention is an operation amount (i.e., the number of multiplications and additions) less than 1/14 of the operation amount A in the case of the related art technique. In practice, use of a fast algorithm for the discrete Fourier transform enables the calculation to be achieved with the number of multiplications and additions N2 or less, and therefore, the number of computations is further reduced to achieve more quick generation of the autocorrelation map. As a result, the processes for identifying the tune structure or the chorus can be performed more quickly, for example.

As described above, the present invention makes it possible to analyse the waveform of the tune involving the modulation with a reduced operation amount.

Further, the present invention makes it possible to identify, based on the waveform of the tune involving the modulation, the structure of the tune with a reduced operation amount.

The above-described series of processes can be implemented by either hardware or software. In the case where the series of processes are implemented by software, a program that forms the software and is stored in a storage medium is installed into a dedicated computer or a general-purpose personal computer that, when various programs are installed thereon, becomes capable of performing various functions, for example.

This storage medium may be the removable medium 21 in FIG. 2, which is distributed, separately from the computer, for providing the program to the user and which has the program recorded thereon, such as a magnetic disk (e.g., a flexible disk), an optical disk (e.g., a CD-ROM (Compact Disc-Read Only Memory) or a DVD (Digital Versatile Disk)), a magneto-optical disk (e.g., an MD (Mini-Disk)(a registered trademark)), or a semiconductor memory. Alternatively, the above storage medium may be the ROM 12 or the recording section 18 in FIG. 2, which is originally contained in the computer and thus provided to the user and which has the program stored therein.

Further, the program for executing the above-described series of processes may be installed into the computer via a wired or wireless communication medium, such as a local area network, the Internet, or digital satellite broadcasting, through an interface such as a router or a modem as necessary.

Note that the steps implemented by the program stored in the storage medium and described in the present specification may naturally be performed chronologically in order of description but do not have to be performed chronologically. Some steps may be performed in parallel or independently.

Also note that embodiments of the present invention are not limited to the above-described embodiments. It should be understood that various modifications can be devised without departing from the scope of the invention.

The invention claimed is:

1. An information processing apparatus, comprising:

first extraction means for extracting a first feature from first sections of a waveform of a tune involving a modulation, each of the first sections corresponding to each beat, the first feature being related to the beat;

removal means for removing a phase component from a frequency component of each first feature extracted;

generation means for, based on the first features whose phase components have been removed, generating autocorrelation information representing correlation between one said first section and another said first section;

separation means for, based on the autocorrelation information, separating the beats into a plurality of second sections each containing a succession of beats with high correlation;

second extraction means for extracting a second feature from each of the second sections obtained by the separation, the second feature representing a musical feature of the tune; and identification means for, based on the second feature, identifying a tune structure component of the tune in the second sections as separated.

2. The information processing apparatus according to claim 1, wherein said removal means removes the phase component from the frequency component of each first feature by a discrete Fourier transform.

3. The information processing apparatus according to claim 1, wherein said identification means identifies, as the tune structure component, a section corresponding to a chorus of the tune.

4. The information processing apparatus according to claim 1, wherein the first feature is energy of each tone in a predetermined number of octaves in the first section.

5. The information processing apparatus according to claim 1, wherein the second feature is volume, information concerning a sound source, or a gain of a certain frequency band in the second section.

6. The information processing apparatus according to claim 5, wherein the second feature is a length of the second section, the number of times the second section appears, or the number of times the second section is repeated consecutively.

7. The information processing apparatus according to claim 3, wherein, based on the first features whose phase components have been removed, said generation means calculates, at intervals of a predetermined, number of beats, the correlation with another said first section to generate the autocorrelation information.

8. The information processing apparatus according to claim 1, wherein said removal means removes the phase component from the frequency component of each first feature whose been shuffled.

9. The information processing apparatus according to claim 4, wherein said removal means shifts the energy of each tone before removing the phase component from the frequency component of each first feature.

10. An information processing method, comprising:

a first extraction step of extracting a first feature from first sections of a waveform of a tune involving a modulation, each of the first sections corresponding to each beat, the first feature being related to the beat;

a removal step of removing a phase component from a frequency component of each feature extracted;

a generation step of, based on the features whose phase components have been removed, generating autocorrelation information representing correlation between one said section and another said section;

a separation step for, based on the autocorrelation information, separating the beats into a plurality of second sections each containing a succession of beats with high correlation;

a second extraction step for extracting a second feature from each of the second sections obtained by the separation, the second feature representing a musical feature of the tune; and an identification step for, based on the second feature, identifying a tune structure component of the tune in the second sections as separated.

11. A program for causing a computer to perform:

a first extraction step of extracting a first feature from first sections of a waveform of a tune involving a modulation, each of the first sections corresponding to each beat, the first feature being related to the beat;

a removal step of removing a phase component from a frequency component of each feature extracted;

a generation step of, based on the features whose phase components have been removed, generating autocorrelation information representing correlation between one said section and another said section;

a separation step for, based on the autocorrelation information, separating the beats into a plurality of second sections each containing a succession of beats with high correlation;

a second extraction step for extracting a second feature from each of the second sections obtained by the separation, the second feature representing a musical feature of the tune; and an identification step for, based on the second feature, identifying a tune structure component of the tune in the second sections as separated.

* * * * *